US007766315B2

(12) United States Patent
Ishikawa et al.

(10) Patent No.: US 7,766,315 B2
(45) Date of Patent: Aug. 3, 2010

(54) SHEET STACKING APPARATUS AND METHOD OF CONTROLLING THE SHEET STACKING APPARATUS

(75) Inventors: Naoki Ishikawa, Kashiwa (JP); Tsuyoshi Moriyama, Toride (JP); Yasuo Fukatsu, Abiko (JP); Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/145,629

(22) Filed: Jun. 25, 2008

(65) Prior Publication Data

US 2009/0001649 A1 Jan. 1, 2009

(30) Foreign Application Priority Data

Jun. 28, 2007 (JP) ..... 2007-170997

(51) Int. Cl.
*B65H 33/04* (2006.01)
*B65H 39/00* (2006.01)

(52) U.S. Cl. ..... 270/58.19; 270/58.08; 270/58.09; 270/58.01; 270/58.11

(58) Field of Classification Search ..... 270/58.08, 270/58.09, 58.01, 58.11
See application file for complete search history.

(56) References Cited

U.S. PATENT DOCUMENTS 6,594,545 B1 * 7/2003 Kakigi ..... 700/223
7,469,896 B2 * 12/2008 Sato et al. ..... 271/287
2007/0090584 A1 * 4/2007 Brown et al. ..... 270/58.09

FOREIGN PATENT DOCUMENTS

| | | | |
|---|---|---|---|
| JP | 8-143209 A | | 6/1996 |
| JP | 08143209 A | * | 6/1996 |
| JP | 2002-338126 A | | 11/2002 |
| JP | 2002338126 A | * | 11/2002 |
| JP | 2006-124052 A | | 5/2006 |

* cited by examiner

*Primary Examiner*—Gene Crawford
*Assistant Examiner*—Yolanda Cumbess
(74) *Attorney, Agent, or Firm*—Rossi, Kimms & McDowell LLP

(57) ABSTRACT

A sheet stacking apparatus which is capable of efficiently stacking sheets of various sizes while making efficient use of space therein to realizing compactness of the apparatus. Stacker trays that are driven by respective tray lift motors perform a lifting/lowering operation to have sheets stacked thereon. Selection is made according to the size of sheets between a first stacking mode for stacking sheets having a size not larger than a predetermined size on one of the stacker trays and a second stacking mode for stacking sheets having a size larger than the predetermined size in a state extending on the stacker trays. When it is determined that one of the stacker trays is faulty, execution of the second stacking mode is inhibited, and execution of the first stacking mode using the other stacker tray is permitted.

5 Claims, 27 Drawing Sheets

SHEET STACKING APPARATUS AND METHOD OF CONTROLLING THE SHEET STACKING APPARATUS

BACKGROUND OF THE INVENTION

1. Field of the Invention

The present invention relates to a sheet stacking apparatus for stacking sheets, and a method of controlling the sheet stacking apparatus.

2. Description of the Related Art

With recent progress of the technology, image forming apparatuses come to form images on sheets at increased speed, and in accordance therewith, sheet stacking apparatuses that stack a large amount of sheets discharged from the image forming apparatuses at the increased speed have also been demanded to stack an even larger amount of sheets with a still higher accuracy.

A technique concerning such a large capacity sheet stacking apparatus (hereinafter referred to as "the stacker") has been disclosed e.g. in Japanese Patent Laid-Open Publication No. 2006-124052. A stacker disclosed in Japanese Patent Laid-Open Publication No. 2006-124052 proposes a compact stacker which is capable of detecting a fully stacked state of sheets on a tray. This conventional stacker will be described with reference to FIG. 27.

FIG. 27 is a schematic cross-sectional view of the conventional stacker.

A sheet discharged from the image forming apparatus is received by an inlet roller 501, and then a leading end thereof is passed to a gripper 503 by a conveying roller 502. The gripper 503 conveys the sheet while gripping the leading end thereof. After the leading end of the sheet collides against a leading end stopper 504, the gripper 503 let the sheet fall onto a sheet stacking table 505. By repeatedly carrying out this operation, a predetermined number of sheets are stacked on the sheet stacking table 505.

Depending on the case, the stacker is designed such that whenever a sheet is stacked, an alignment process is carried out for aligning ends of the sheets by an alignment plate, not shown, in a direction orthogonal to a sheet-conveying direction, whereby alignment of sheets is improved.

Further, techniques for stacking a large number of sheets have been disclosed in Japanese Patent Laid-Open Publication No. 2002-338126 and Japanese Patent Laid-Open Publication No. HOB-143209.

In the technique disclosed in Japanese Patent Laid-Open Publication No. 2002-338126, two sheet-stacking spaces are formed by dividing a tray by a partition plate movable in a sheet-discharging direction. When sheets to be stacked are small-size sheets e.g. of A4 or B5 size, it is possible to secure a stacking amount of sheets twice as large as that of an undivided tray, by stacking sheets in the respective sheet-stacking spaces thus formed. When one sheet-stacking space is fully loaded, the partition plate is moved for stacking sheets on the other sheet-stacking space. Since the stacking operation can be continued without taking out stacked sheets, it is possible to shorten a time period over which the associated image forming apparatus is made unavailable, thereby making it possible to enhance working efficiency during stacking of a large amount of sheets.

In the technique disclosed in Japanese Patent Laid-Open Publication No. H08-143209, a plurality of trays are arranged in a stacker in a direction orthogonal to a sheet-conveying direction such that the trays can be switched. Sheets are discharged onto one of the trays arranged as above, and when the one is fully loaded, it is switched to another on which sheets can be stacked, whereby it is possible to stack sheets without making the stacker unavailable. This makes it possible to secure a stacking amount of sheets, which is equal to that provided by a plurality of stackers, which makes it possible to downsize the stacker.

In the above-mentioned conventional sheet stacking apparatus, however, when large-size sheets e.g. of A3 or B4 size are stacked, it is necessary to adapt the size of trays to that of the large-size sheets. As a result, when small-size sheets are stacked, a useless space incapable of stacking sheets increases on each tray, whereby it is impossible to make an efficient use of space within the stacker. This makes it impossible to efficiently stack sheets of various sizes while realizing compactness of the stacker.

SUMMARY OF THE INVENTION

The present invention provides a sheet stacking apparatus which is capable of efficiently stacking sheets of various sizes while making efficient use of space therein to realizing compactness of the apparatus, and a method of controlling the sheet stacking apparatus. Further, the present invention provides a sheet stacking apparatus which is capable of securing a predetermined level of availability even when it is faulty, and a method of controlling the sheet stacking apparatus.

In a first aspect of the present invention, there is provided a sheet stacking apparatus comprising first and second sheet-stacking units configured to stack sheets thereon, lifting driving units configured to cause lifting and lowering operations of the first and second sheet-stacking units, a control unit configured to cause selective execution of one of a first stacking mode in which sheets are caused to be stacked on one of the first and second sheet-stacking units, and a second stacking mode in which sheets are caused to be stacked in a state extending on the first sheet-stacking unit and the second sheet-stacking unit, and an abnormality determination unit configured to determine whether or not any of the first and second sheet-stacking units is abnormal in a lifting/lowering operation by the lifting driving units, wherein when the abnormality determination unit determines that one of the first and second sheet-stacking units is abnormal in the faulty lifting/lowering operation, the control unit inhibits execution of the second stacking mode, and permits execution of the first stacking mode using the other of the first and second sheet-stacking units.

With the configuration of the sheet stacking apparatus according to the first aspect of the present invention, it is possible to efficiently stack sheets of various sizes while making efficient use of pace therein to realize compactness of the apparatus.

Further, even when the sheet stacking apparatus suffers from a faulty lifting/lowering operation one of the sheet stacking units, it is possible to cause sheets to be stacked on the other of the sheet stacking units which is not faulty. This makes it possible to continue the stacking of sheets without stopping the operation of the sheet stacking apparatus, to thereby secure a predetermined level of availability there, when the sheet stacking apparatus suffers from such a faulty operation.

In a second aspect of the present invention, there is provided a method of controlling a sheet stacking apparatus including first and second sheet-stacking units configured to stack sheets thereon, and lifting driving units configured to cause lifting and lowering operations of the first and second sheet-stacking units, the method comprising a stacking mode-selecting step of selecting one of a first stacking mode in which sheets are caused to be stacked on one of the first and second sheet-stacking units, and a second stacking mode in which sheets are caused to be stacked in a state extending on the first sheet-stacking unit and the second sheet-stacking unit, an abnormality determination step of determining whether or not any of the first and second sheet-stacking units is abnormal in a faulty lifting/lowering operation, and a control step of, when the abnormality determination unit determines that one of the first and second sheet-stacking units is abnormal in the faulty lifting/lowering operation, inhibiting execution of the second stacking mode, and permitting execution of the first stacking mode using the other of the first and second sheet-stacking units.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiment thereof.

Figure 1:
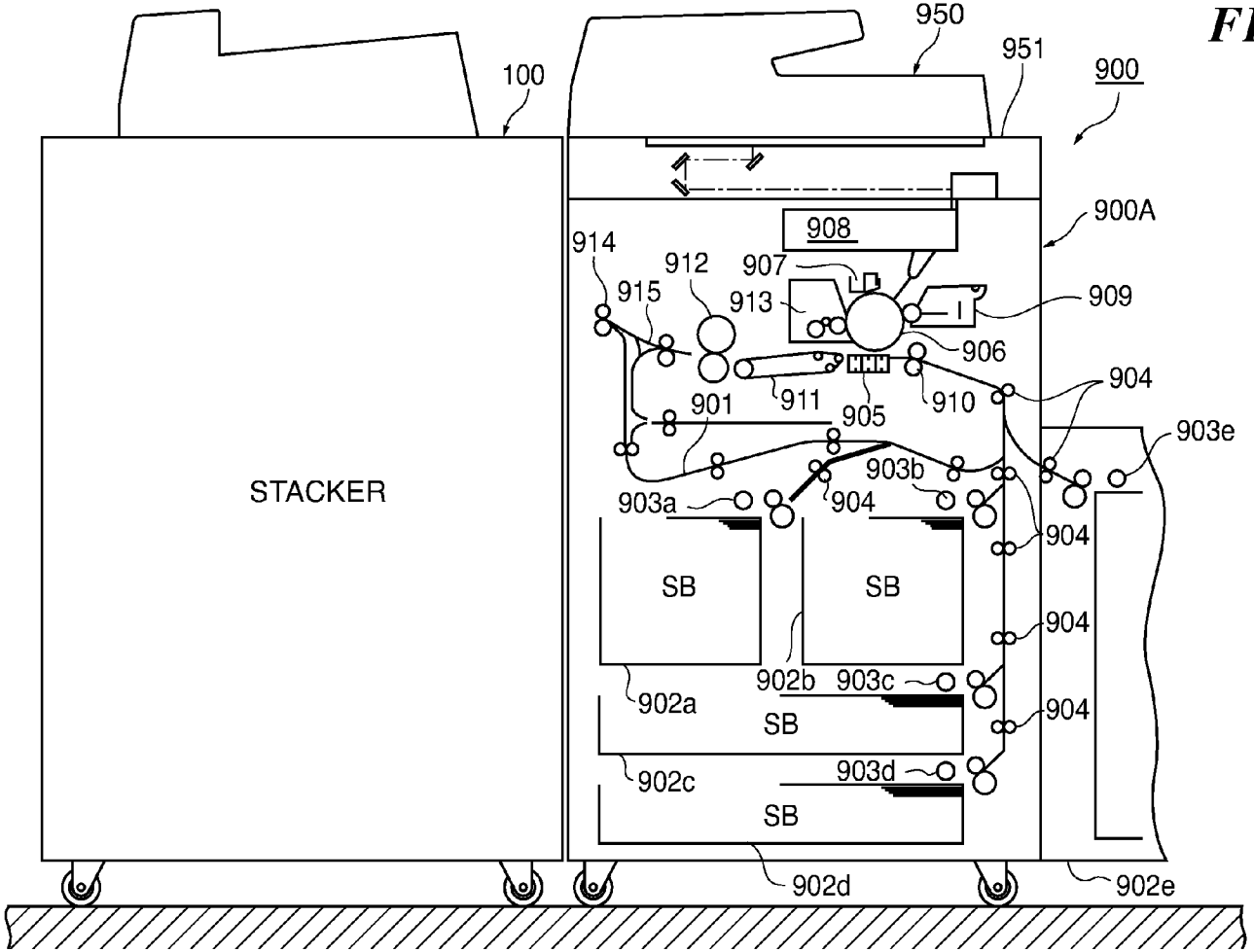
FIG. 1 is a schematic cross-sectional view of an image forming apparatus including a sheet stacking apparatus according to an embodiment of the present invention.

FIG. 1 is a schematic cross-sectional view of an image forming apparatus including a sheet stacking apparatus according to an embodiment of the present invention.

The image forming apparatus 900 includes an automatic document feeder 950 and an image reading device 951, which serve as units for automatically reading originals. Further, the image forming apparatus 900 includes sheet feed cassettes 902*a* to 902*d*, a transfer/detach charger 905, a photosensitive drum 906, a primary electrostatic charger 907, an exposure device 908, and a development device 909, which serve as units for forming images of the originals read by the image reading device 951 on sheets. Furthermore, the image forming apparatus 900 also includes a fixing device 912, a cleaning device 913, and so forth. Further, the image forming apparatus 900 includes e.g. a double-sided sheet inverting device 901 which serves as a unit for forming images on both sides of each sheet.

The image forming apparatus 900 operates as follows:

First, sheet feed rollers 903*a* to 903*d* and conveying roller pairs 904 convey each of sheets set in one of the sheet feed cassettes 902*a* to 902*d* to a registration roller pair 910. On the other hand, the image reading device 951 reads an image of an original fed from the automatic document feeder 950, and the exposure device 908 performs an exposure operation on the photosensitive drum 906, based on digital data of the image of the read original read by the image reading device 951. On the photosensitive drum 906, a series of processes from formation of an electrostatic latent image to visualization thereof is carried out by the exposure device 908, the primary electrostatic charger 907, and the development device 909, whereby a copied toner image is formed on the photosensitive drum 906.

The registration roller pair 910 conveys the sheet to a transfer section in timing in which the leading end of the transfer sheet and that of the toner image on the photosensitive drum 906 are aligned with each other. Then, the transfer/detach charger 905 applies a transfer bias to the sheet, whereby the toner image on the photosensitive drum 906 is transferred onto the transfer sheet.

The sheet having the toner image transferred thereon is conveyed to the fixing device 912 by a transfer belt 911. Then, the sheet is sandwiched by a heating roller and a pressing roller of the fixing device, and has the toner image thermally fixed thereon. At this time, on the photosensitive drum 906, foreign matter, such as remaining toner, which remains adhering to the photosensitive drum 906 without being transferred onto the sheet, is scraped off by a blade of the cleaning device 913 to clear the surface of the photosensitive drum 906 in preparation for the next image forming operation. The sheet that has the toner image fixed thereon is directly conveyed to a stacker 100 by a discharge roller pair 914, or is conveyed to the double-sided sheet inverting device 901 by a flapper 915, so has to have the image forming operation carried out thereon again.

Figure 2:
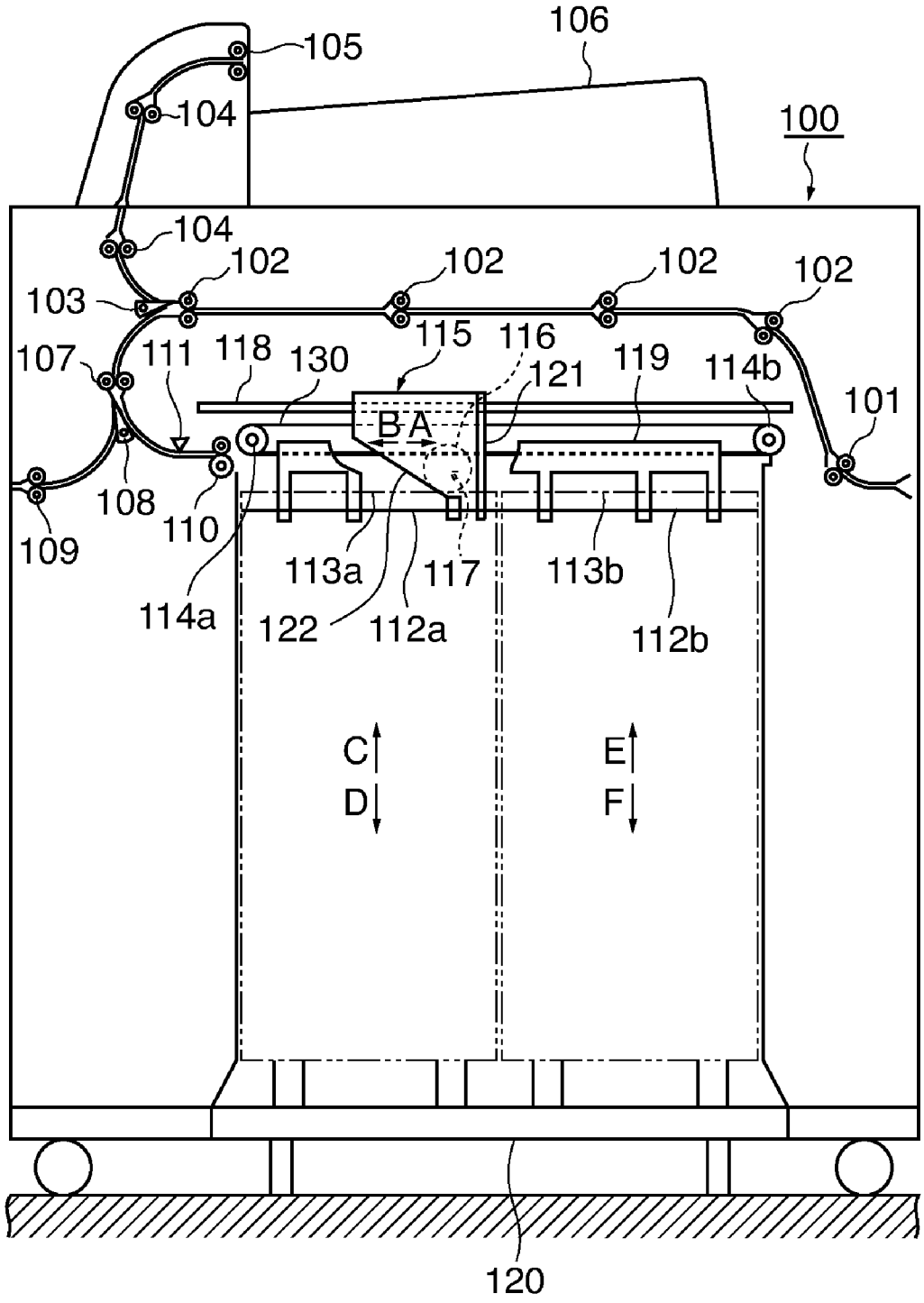
FIG. 2 is a cross-sectional view of a stacker as the sheet stacking apparatus according to the embodiment of the present invention.

FIG. 2 is a cross-sectional view of the stacker 100 as the sheet stacking apparatus according to the embodiment of the present invention.

The stacker 100 is provided with stacker trays 112*a* and 112*b* for stacking sheets discharged from the image forming apparatus 900. The stacker trays 112*a* and 112*b* are each capable of stacking 5000 sheets. The stacker trays 112*a* and 112*b* are arranged such that they can be moved independently of each other in directions indicated by arrows C and D and arrows E and F shown in FIG. 2, by stacker tray lift motors 152*a* and 152*b* (see FIG. 4), respectively. A drawing unit 115 is mounted on a sliding shaft 118 such that it can be moved along the sliding shaft 118 by a drawing motor 153 (see FIG. 4) in directions indicated by arrows A and B. The drawing unit 115 includes a knurled belt 116 for drawing a sheet into a leading end stopper 121, and is configured such that it is rotated by a knurled belt motor 154 (see FIG. 4) in the counterclockwise direction for drawing the sheet to the leading end stopper 121.

A sheet surface-detecting sensor 117 is provided for use in holding the drawing unit 115 at a fixed distance from to the top surface of a bundle of sheets stacked on each stacker tray, and detects the position of the uppermost sheet of the sheet bundle. The sheet surfaces of the respective bundles of sheets stacked on the stacker trays 112*a* and 112*b* are not always detected by the sheet surface-detecting sensor 117 alone, but they are sometimes detected by sheet surface-detecting sensors 113*a* and 113*b*. The sheet surface-detecting sensors 113*a* and 113*b* are used particularly when so-called large-size sheets are stacked which have a size in the sheet conveying direction longer than a predetermined value and are stacked in a state extending on the plurality of stacker trays 112*a* and 112*b*.

Grippers 114*a* and 114*b* that grip the respective leading ends of sheets S for conveying them are mounted on a drive belt 130 in a state urged by a torsion coil spring, not shown, in the clockwise direction. The grippers 114*a* and 114*b* are configured such that they can be moved in a circulating manner in the counterclockwise direction by a drive belt motor 155 (see FIG. 4). The stacker trays 112*a* and 112*b* are for stacking discharged sheets S, and are in respective standby positions dependent on signals from the sheet surface-detecting sensors 113*a* and 113*b*, for stacking the sheets S in their home positions. The sheet surface-detecting sensors 113*a* and 113*b* are used as sensors for detecting the home positions of the stacker trays 112*a* and 112*b* during the initial operation of the stacker 100 while serving as sheet surface-detecting sensors for the stacker trays 112*a* and 112*b* during the stacking operation of the stacker 100.

Further, an alignment plate 119 is arranged over the stacker trays 112*a* and 112*b*. The alignment plate 119 has the function of performing a swinging operation (jogging operation) in a direction orthogonal to the sheet conveying direction for alignment of the side ends of the sheets S.

An inlet roller pair 101, conveying roller pairs 102 and 107, outlet-switching flappers 103 and 108, and a stacker tray discharge roller 110 are arranged on a conveying passage for conveying sheets discharged from the image forming apparatus 900 to the stacker trays 112*a* and 112*b*. Disposed at a location upstream of the stacker tray discharge roller 110 is a timing sensor 111, described hereinafter.

Further, the stacker 100 includes a top tray 106 in addition to the stacker trays 112*a* and 112*b*, as discharge destinations to which sheets discharged from the image forming apparatus 900 are discharged. Conveying roller pairs 104 and a top tray discharge roller 105 are arranged on a conveying passage for conveying the sheets discharged from the image forming apparatus 900 to the top tray 106. Furthermore, an outlet roller pair 109 is disposed on a conveying passage for discharging sheets discharged from the image forming apparatus 900 to a sheet processing apparatus, not shown, disposed at a position downstream of the stacker 100.

A dolly 120 for conveying stacked sheets is removably disposed at the bottom of the stacker 100. The dolly 120 is for conveying sheet bundles SB fully stacked on the stacker trays 112*a* and 112*b* out of the stacker 100.

Figure 3:
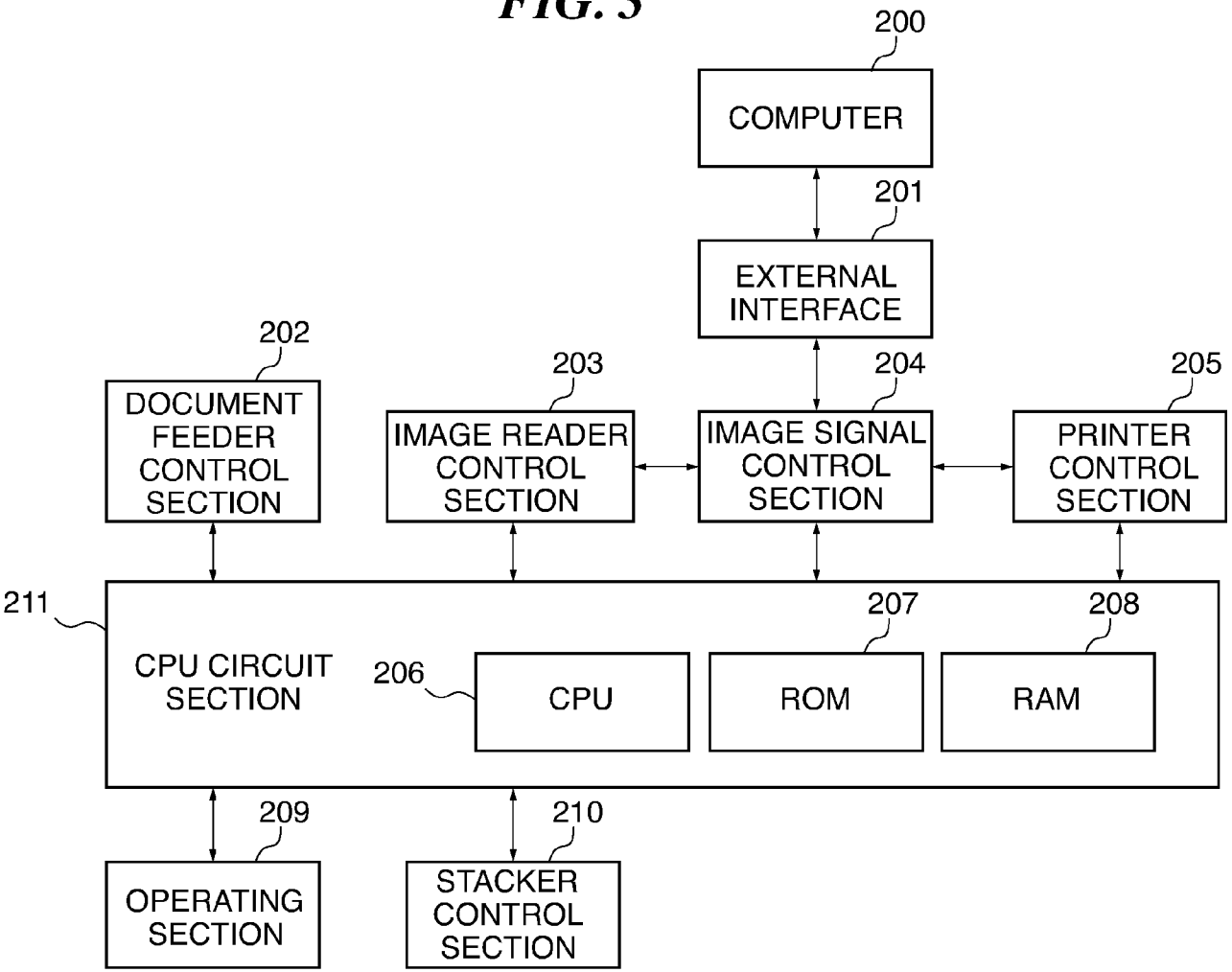
FIG. 3 is a block diagram of a control system of the image forming apparatus and the stacker.

Next, the control system of the image forming apparatus 900 and the stacker 100 will be described with reference to FIG. 3. FIG. 3 is a block diagram of the control system of the image forming apparatus 900 and the stacker 100.

The image forming apparatus 900 includes a CPU circuit section 211. The CPU circuit section 211 is comprised of a CPU 206, a ROM 207, and a RAM 208, and performs centralized control of functional blocks 202, 209, 203, 204, 201, 205, and 210, based on control programs (including programs associated with a sheet stacking process, described hereinafter, according to the present embodiment) stored in the ROM 207. The RAM 208 temporarily stores control data, and is also used as a work area for carrying out arithmetic operations involved in control processing.

The document feeder control section 202 drivingly controls the automatic document feeder 950 according to instructions from the CPU 206. The image reader control section 203 drivingly controls the above-described image reading device 951, and so forth, and transfers an analog image signal output from the image reading device 951 to the image signal control section 204.

The image signal control section 204 converts the analog image signal input from the image reading device 951 into a digital signal, then performs predetermined processing on the digital signal, and converts the processed digital signal into a video signal, followed by delivering the video signal to the printer control section 205. Further, the image signal control section 204 performs various kinds of processing on a digital image signal input from a computer 200 via the external interface 201, and converts the processed digital image signal into a video signal, followed by delivering the video signal to the printer control section 205. The processing operations executed by the image signal control section 204 are controlled by the CPU circuit section 211. The printer control section 205 drives the aforementioned exposure device 908 based on the video signal input from the image signal control section 204.

The operating section 209 includes a plurality of keys for use in configuring various functions for the image forming operation, and a display section for displaying information indicative of settings. Further, the operating section 209 outputs a key signal in accordance with operation of each key to the CPU 206, and displays corresponding information on the display section based on a signal from the CPU 206. The stacker control section 210 is mounted on the stacker 100, and exchanges information with the CPU 206, to thereby drivingly control the overall operation of the stacker 100.

Next, the stacker control section 210 will be described with reference to FIG. 4.

Figure 4:
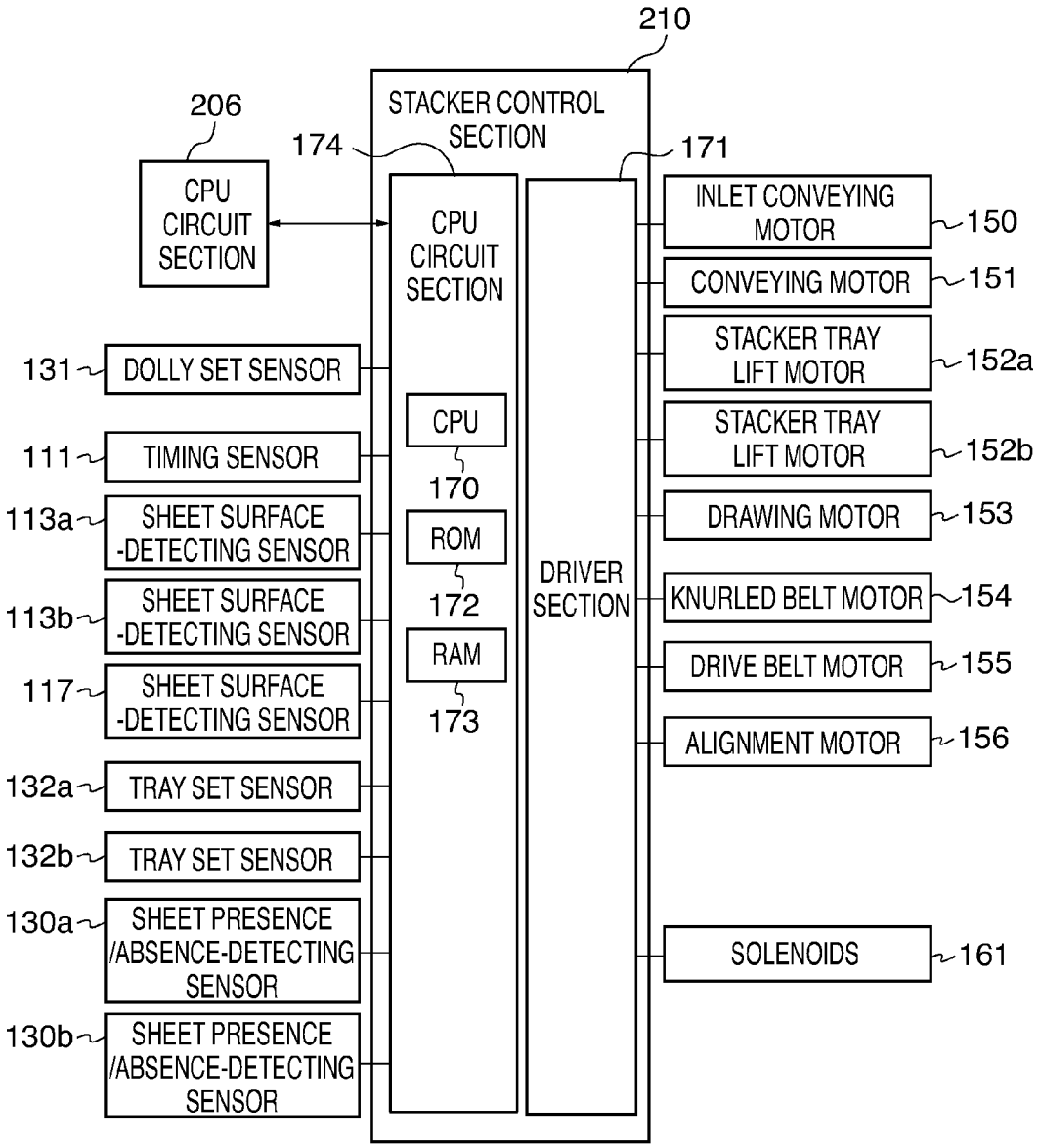
FIG. 4 is a block diagram of a stacker control section.

FIG. 4 is a block diagram of the stacker control section 210.

As shown in FIG. 4, the stacker control section 210 is comprised e.g. of a CPU circuit section 174 provided with a CPU 170, a ROM 172, and a RAM 173, and a driver section 171. The CPU 170 performs centralized control of the functional blocks of the stacker 100 based on control programs stored in the ROM 172, for realizing the sheet stacking process, described hereinafter, according to the present embodiment.

Further, various sensors and encoders are connected to the CPU circuit section 174. The sensors include a dolly set sensor 131, a timing sensor 111, the sheet surface-detecting sensors 113*a*, 113*b* and 117, and so forth. The dolly set sensor 131 detects a removed or mounted state of the dolly 120. The encoders include a lift motor encoders 132*a* and 132*b*.

Further, various motors and solenoids are connected to the driver section 171. The motors include an inlet conveying motor 150, a conveying motor 151, the stacker tray lift motors 152*a* and 152*b*, the drawing motor 153, the knurled belt motor 154, the drive belt motor 155, an alignment motor 156, and so forth. The inlet conveying motor 150 drives the inlet roller pair 101. The conveying motor 151 drives the conveying roller pairs 102 and 107. The stacker tray lift motors 152*a* and 152*b* drives the stacker trays 112*a* and 112*b* for lifting and lowering the same. The drawing motor 153 drives the drawing unit 115. The knurled belt motor 154 drives the knurled belt 116. The drive belt motor 155 drives the drive belt 130. The alignment motor 156 drives the alignment plate 119.

Further, the solenoids connected to the driver section 171 include e.g. solenoids 161 for switching between sheet conveying paths.

Figure 5:
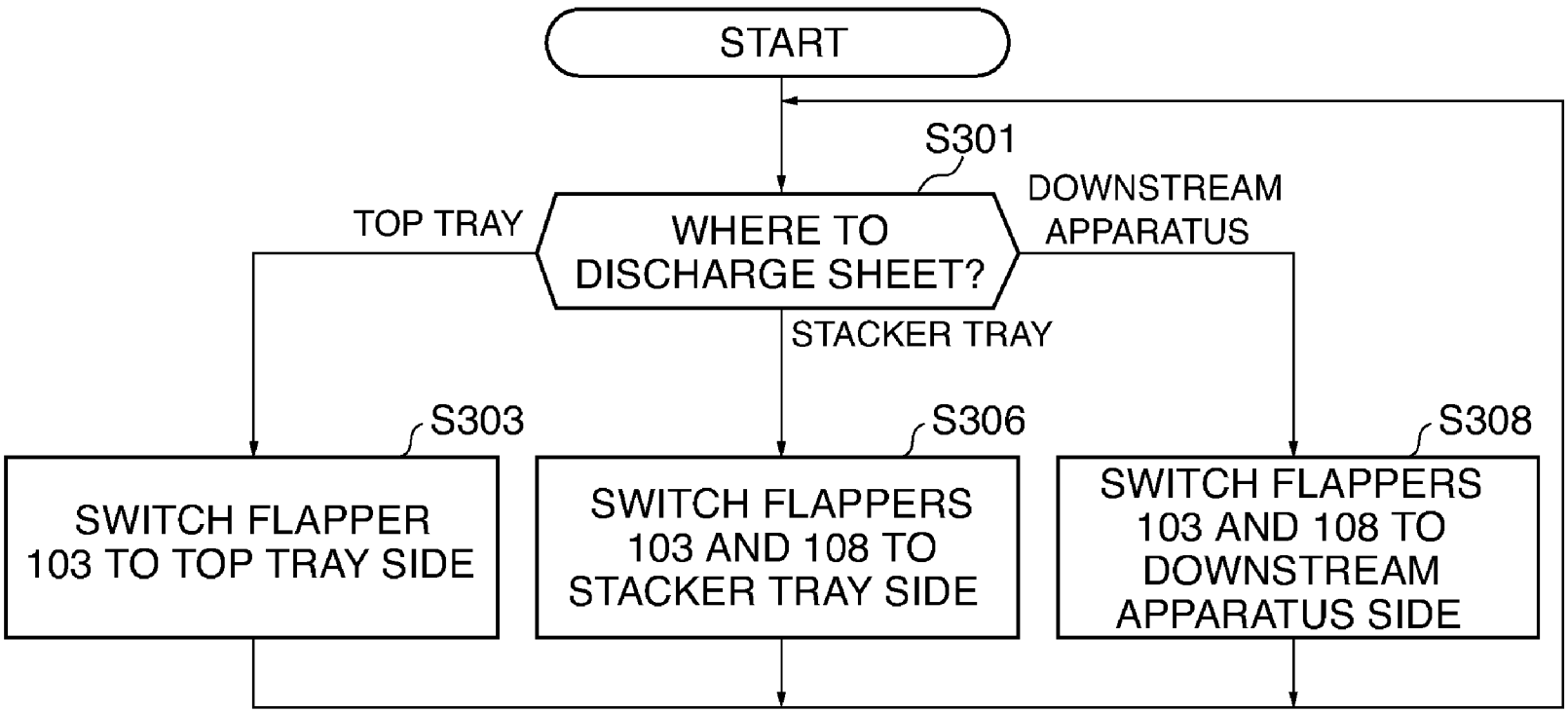
FIG. 5 is a flowchart of a sheet conveying process carried out by the stacker according to the present embodiment.

Next, a sheet conveying operation carried out by the stacker 100 configured as above will be described with reference to FIG. 5. FIG. 5 is a flowchart of a sheet conveying process carried out by the stacker 100 according to the present embodiment.

Sheets discharged from the image forming apparatus 900 are each conveyed into the stacker 100 by the inlet roller pair 101 of the stacker 100, and conveyed to the flapper 103 by the conveying roller pairs 102. Before the sheets are conveyed, information on the sheets is sent in advance from the CPU 206 of the image forming apparatus 900 to the stacker control section 210. The information on the sheets includes e.g. information on the size and type of the sheets, and information on a discharge destination of the sheets.

The CPU 170 judges a discharge destination of the sheets (step S301). When the discharge destination of the sheets is the top tray 106, the CPU 170 drives one of the solenoids 161 to thereby switch the flapper 103 such that the sheets are guided into the conveying roller pair 104 (S303). The sheets thus conveyed are discharged to the top tray 106 by the top tray discharge roller 105, and are stacked on the top tray 106.

On the other hand, when the discharge destination of the sheets is the stacker trays 112*a* and 112*b*, the CPU 170 drives the solenoids 161 to switch the flapper 103 such that the sheets are guided to the conveying roller pair 107, and switch the flapper 108 such that they are guided to the conveying roller pair 110 (S306). The sheets conveyed by the conveying roller pairs 102 are discharged to the stacker trays 112*a* and 112*b* by the conveying roller pair 107 and the stacker tray discharge roller 110, and are stacked on the stacker trays 112*a* and 112*b*.

Further, when the discharge destination of the sheets is a sheet processing apparatus, not shown, on the downstream side of the stacker 100, the CPU 170 drives the solenoids 161 to switch the flapper 103 such that the sheets are guided to the conveying roller pair 107, and switch the flapper 108 such that the same are guided to the sheet processing apparatus on the downstream side (S308). The sheets having been conveyed by the conveying roller pairs 102 are then conveyed by the conveying roller pair 107, and are guided by the outlet roller pair 109, followed by being conveyed to the sheet processing apparatus on the downstream side of the stacker 100.

Hereinafter, a description will be given of details of sheet stacking control performed when the sheets are stacked on the stacker trays 112*a* and 112*b*.

FIGS. 6, 7, 8 and 9 are cross-sectional views of essential parts of the stacker in states during the sheet stacking process carried out using the stacker tray 112*a*. FIGS. 10, 11, 12 and 13 are cross-sectional views of essential parts of the stacker in states during the sheet stacking process carried out using the stacker tray 112*b*.

Before the sheets are conveyed to the stacker 100, information on the sheets S, such as information on the size and type of the sheets S, is notified to the stacker control section 210 by the CPU 206 of the image forming apparatus 900. The stacker control section 210 determines the number of stacker trays used in the sheet stacking process based on the notified information. More specifically, it is determined whether the sheet stacking process is performed using one stacker tray (first stacking mode) or using a plurality of stacker trays and causing the stacker trays to function as one tray (second stacking mode). In the present embodiment, when the sheet stacking process is carried out using one stacker tray, small-size sheets (not larger than a predetermined size, i.e. not larger than the A4 size) are stacked.

Figure 6:
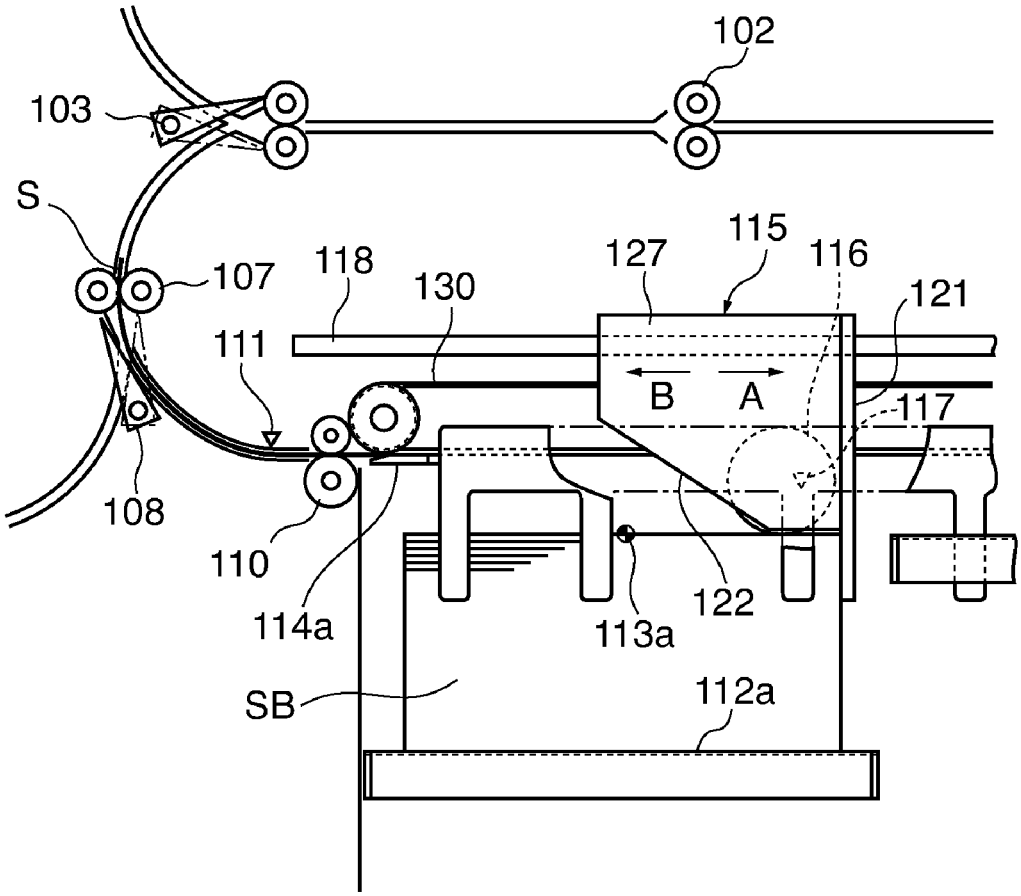
FIG. 6 is a cross-sectional view of essential parts of the stacker in a state where a sheet stacking process is being carried out using one stacker tray.
Figure 7:
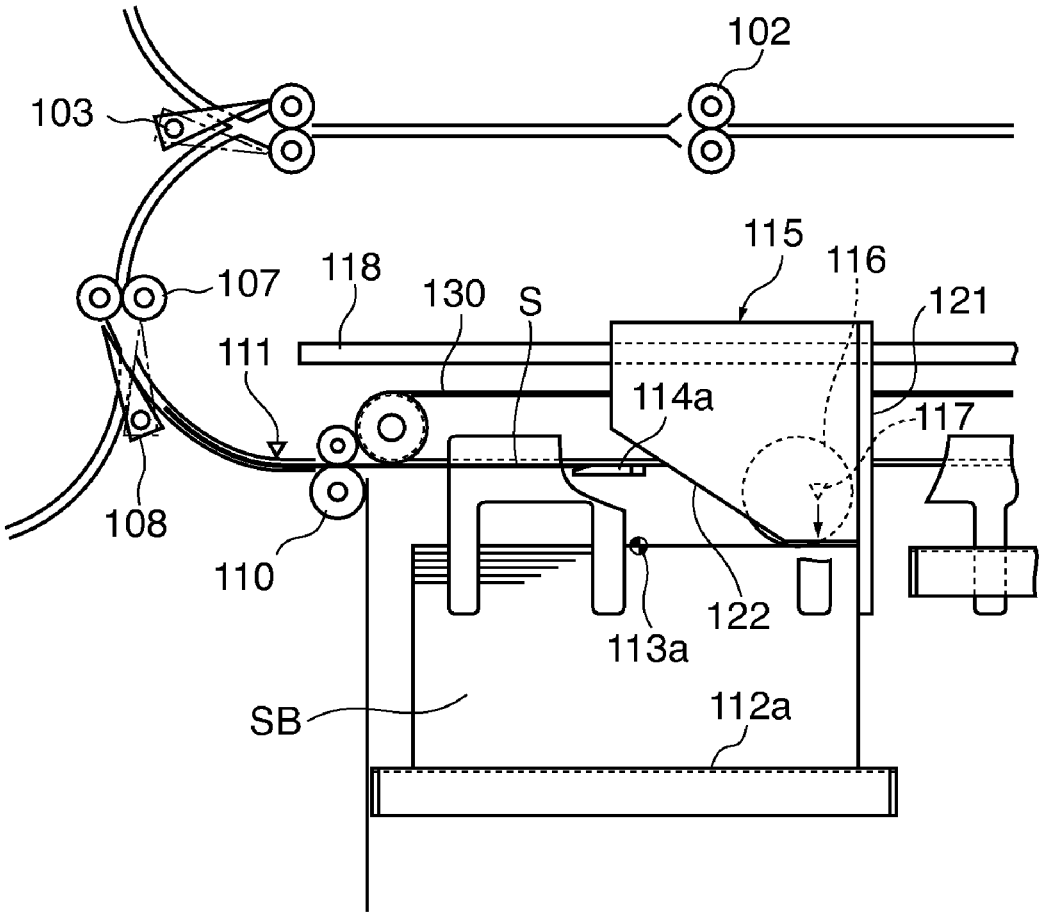
FIG. 7 is a cross-sectional view of essential parts of the stacker in a state where the sheet stacking process is being carried out using one stacker tray.

As shown in FIG. 6, a small-size sheet S discharged from the image forming apparatus 900 is conveyed to the stacker tray discharge roller 110 by the above-described sheet conveying operation. Then, passage timing in which the leading end of the sheet S passes through the stacker tray discharge roller 110 is detected by the timing sensor 111 disposed on the upstream side of the stacker tray discharge roller 110. Then, timing in which the leading end of the sheet S is gripped by the gripper 114*a* stopped and waiting is predicted based on the passage timing, and the gripper 114*a* is driven in synchronism with the predicted timing. This causes the gripper 114*a* to convey the sheet S toward the drawing unit 115 while gripping the leading end of the sheet S, as shown in FIG. 7.

Figure 8:
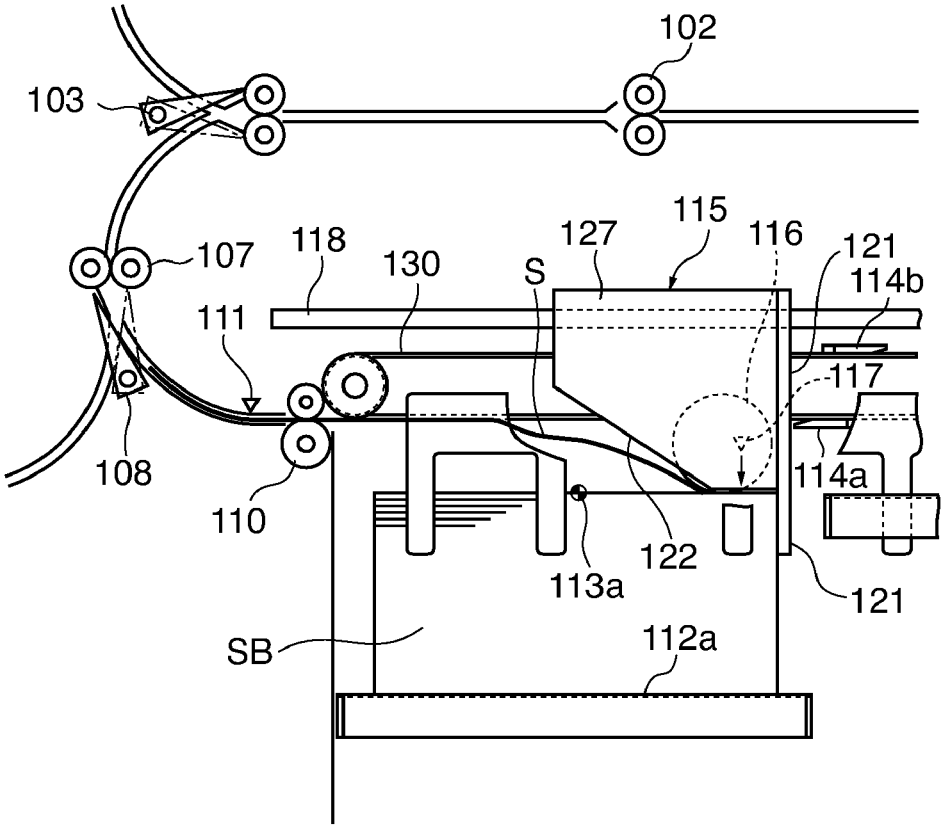
FIG. 8 is a cross-sectional view of essential parts of the stacker in a state where the sheet stacking process is being carried out using one stacker tray.
Figure 9:
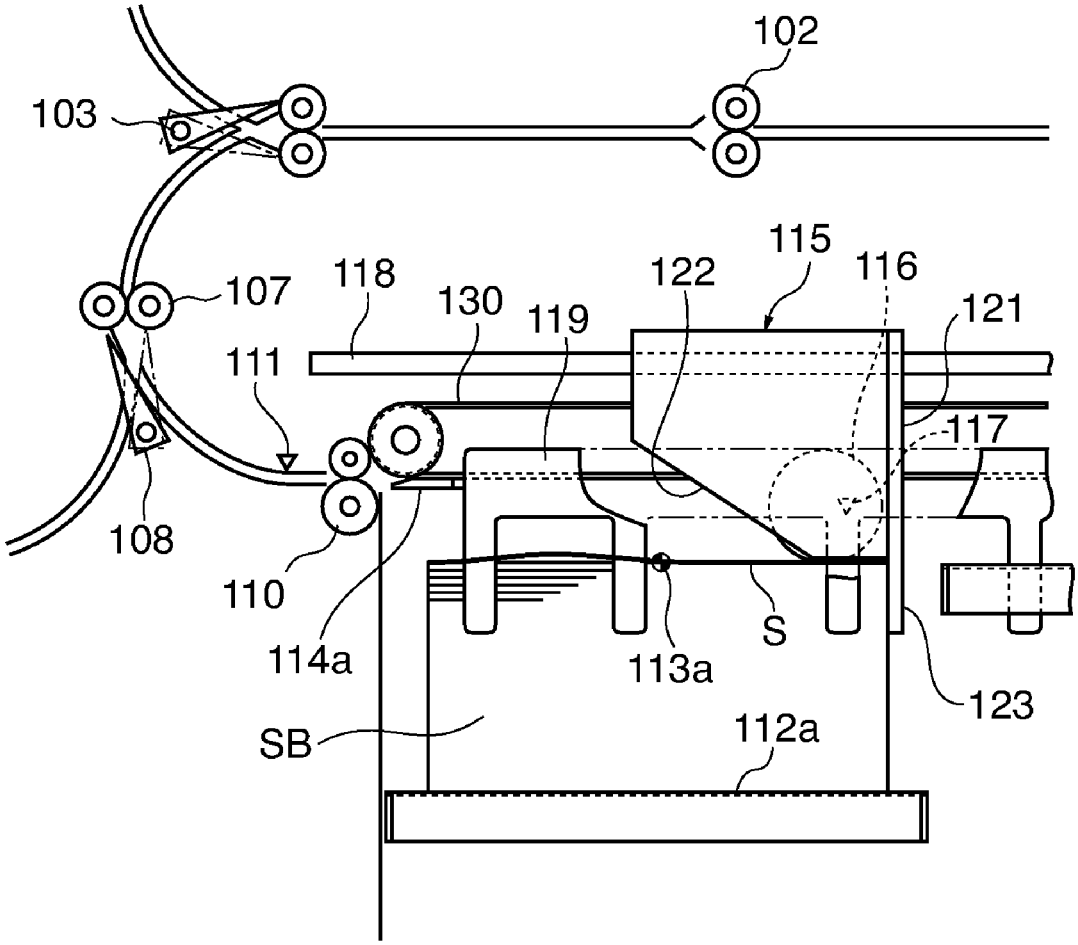
FIG. 9 is a cross-sectional view of essential parts of the stacker in a state where the sheet stacking process is being carried out using one stacker tray.

Referring to FIG. 8, when the gripper 114*a* passes through a tapered portion 122 of the drawing unit 115, the sheet S is conveyed while the leading end of the sheet S is urged by the tapered portion 122 toward the stacker tray 112*a*, whereby it is guided to the knurled belt 116. Thereafter, as shown in FIG. 9, the sheet S is conveyed by the knurled belt 116 until the leading end of the sheet S is brought into abutment with the leading end stopper 121, whereby the sheets S are stacked on the stacker tray 112*a* in a state in which the leading ends thereof are aligned. Then, the alignment plate 119 for the stacker tray 112*a* performs the jogging operation in the direction orthogonal to the sheet conveying direction, to thereby align the side ends of the sheets S.

On the other hand, the sheet surface-detecting sensors 117 and 113*a* always monitor the position of the top of a bundle of sheets S stacked on the stacker tray 112*a*. When the distance between the drawing unit 115 and the top of the sheet bundle becomes smaller than a predetermined value, the stacker tray 112*a* is lowered by a predetermined distance by the stacker tray lift motor 152*a*, whereby the distance between the drawing unit 115 and the sheet surface is controlled to be constant. By repeatedly carrying out this operation, the sheets S are sequentially stacked on the stacker tray 112*a*.

Normally, the fully stacked state of the sheet bundle SB stacked on the stacker tray 112*a* is detected by counting the number of the sheets S discharged from the stacker tray discharge roller 110. Alternatively, it is detected by a sensor, not shown, which detects the height of the sheet bundle SB stacked on the stacker tray 112*a*. When the sheet bundle SB on the stacker tray 112*a* is in the fully stacked state, the stacker tray 112*a* automatically lowers to be fixed on the dolly 120.

Figure 10:
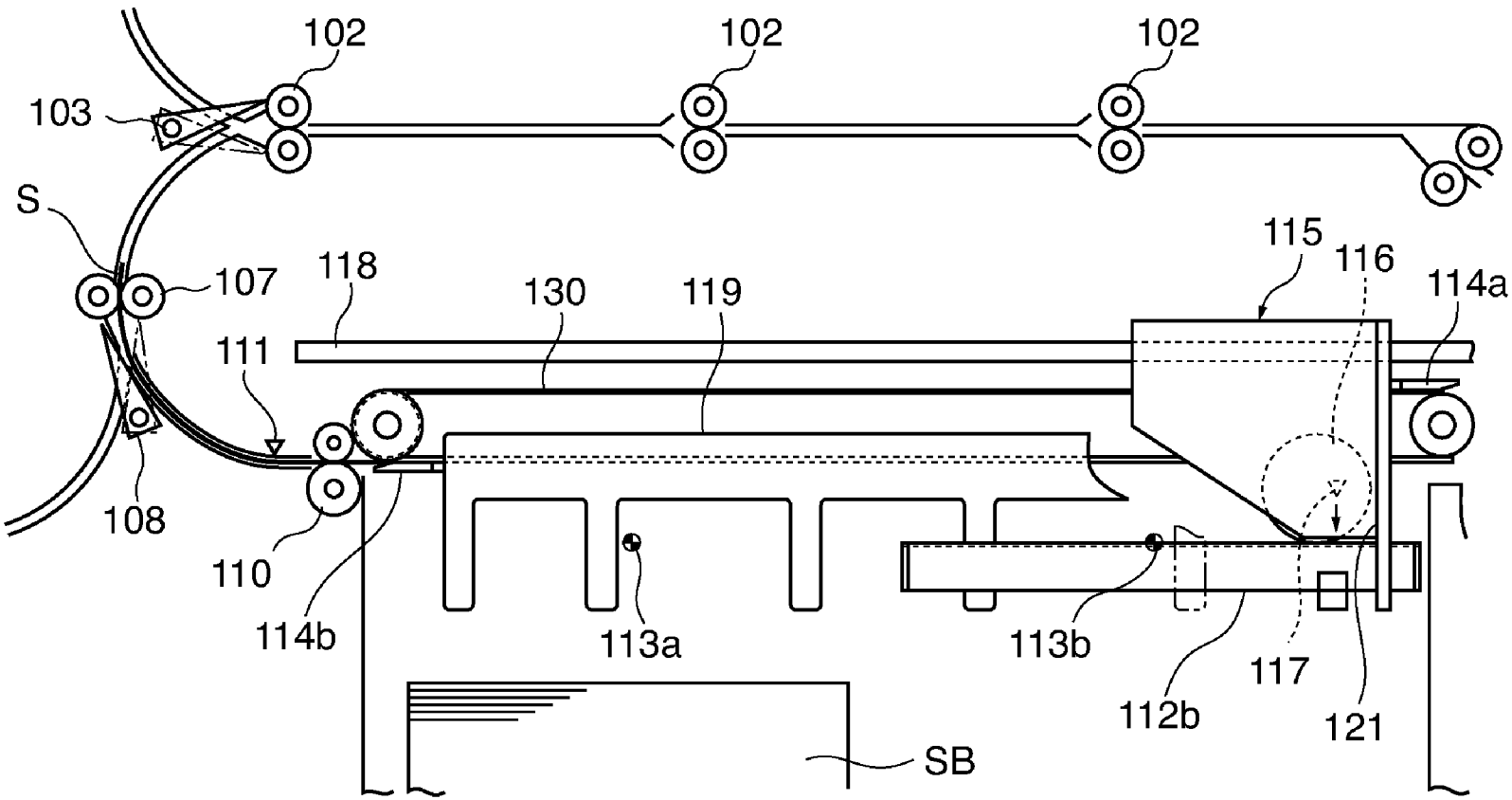
FIG. 10 is a cross-sectional view of essential parts of the stacker in a state where a sheet stacking process is being carried out using the other stacker tray.

Then, as shown in FIG. 10, the drawing unit 115 moves to the adjacent stacker tray 112*b* having no sheets stacked thereon, and waits above the stacker tray 112*b* for conveyance of sheets to the stacker tray 112*b*.

Figure 11:
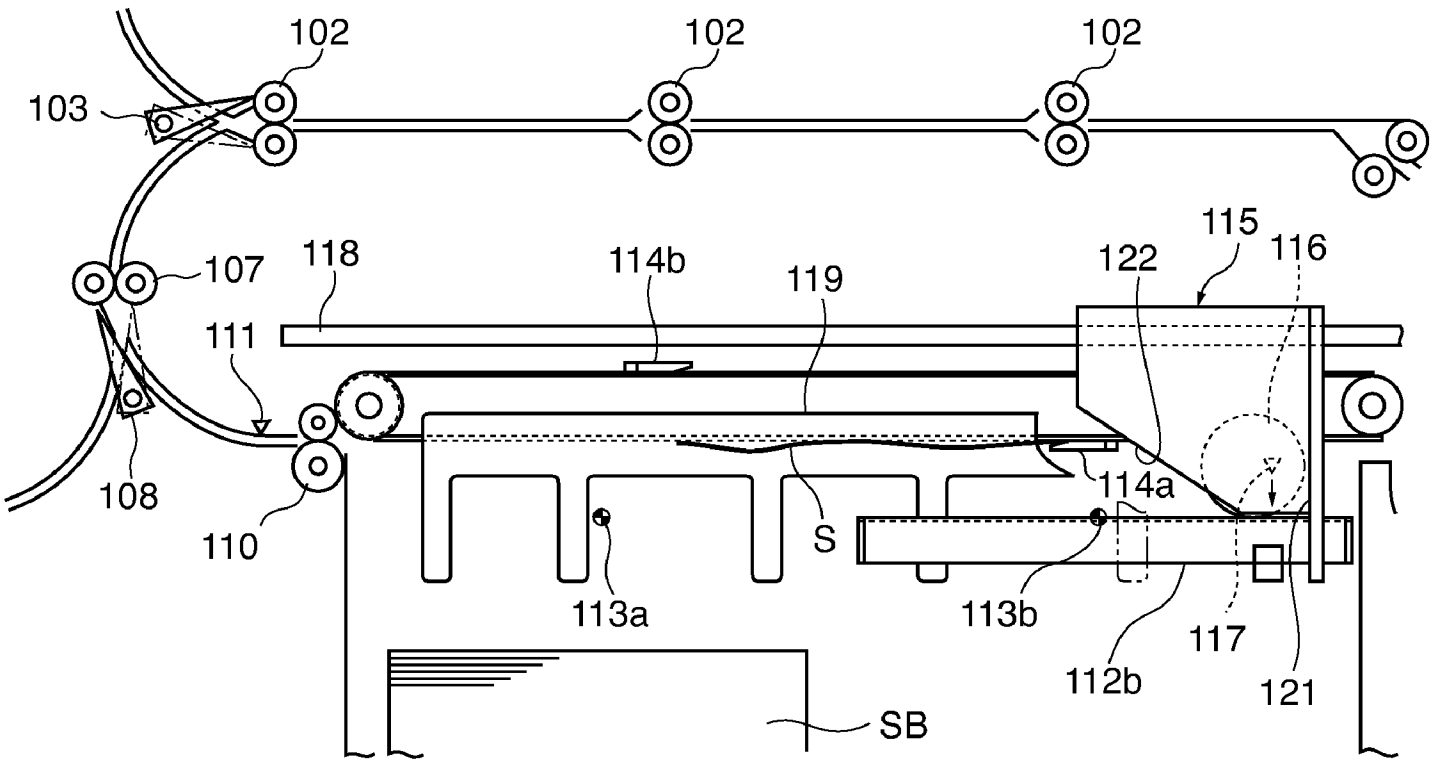
FIG. 11 is a cross-sectional view of essential parts of the stacker in a state where the sheet stacking process is being carried out using the other stacker tray.

Then, after a sheet S discharged from the image forming apparatus 900 has passed through the timing sensor 111, the sheet is discharged by the stacker tray discharge roller 110. Then, as shown in FIG. 11, the leading end of the sheet is gripped by the gripper 114*a*, and is conveyed toward the drawing unit 115 waiting above the stacker tray 112*b*.

Figure 12:
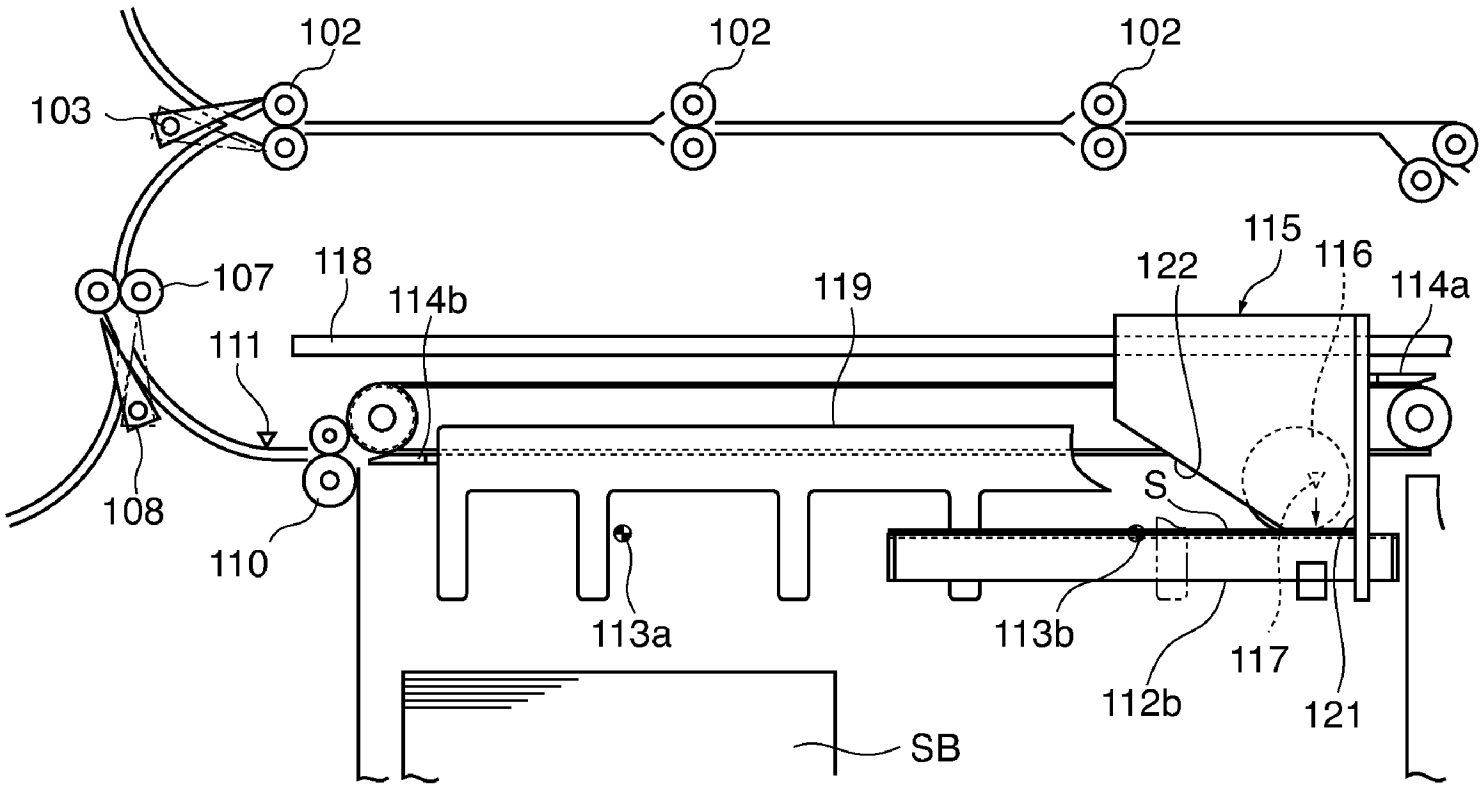
FIG. 12 is a cross-sectional view of essential parts of the stacker in a state where the sheet stacking process is being carried out using the other stacker tray.

After the gripper 114*a* has passed through the tapered portion 122 of the drawing unit 115, the sheet S is guided to the knurled belt 116 similarly to the case of being stacked on the stacker tray 112*a*. Thus, as shown in FIG. 12, sheets S are sequentially stacked on the stacker tray 112*b* with leading ends thereof aligned. Then, the alignment plate 119 aligns the side ends of the sheets S.

The sheet surface-detecting sensors 117 and 113*a* always monitor the position of the top of the bundle of sheets S stacked on the stacker tray 112*b*. When the distance between the drawing unit 115 and the top of the sheet bundle becomes shorter than a predetermined value, the stacker tray 112*b* is lowered by a predetermined distance by the stacker tray lift motor 152*a*, whereby the distance between the drawing unit 115 and the top of the sheet bundle is controlled to be constant. By repeatedly carrying out this operation, the sheets S are sequentially stacked on the stacker tray 112*b*.

Figure 13:
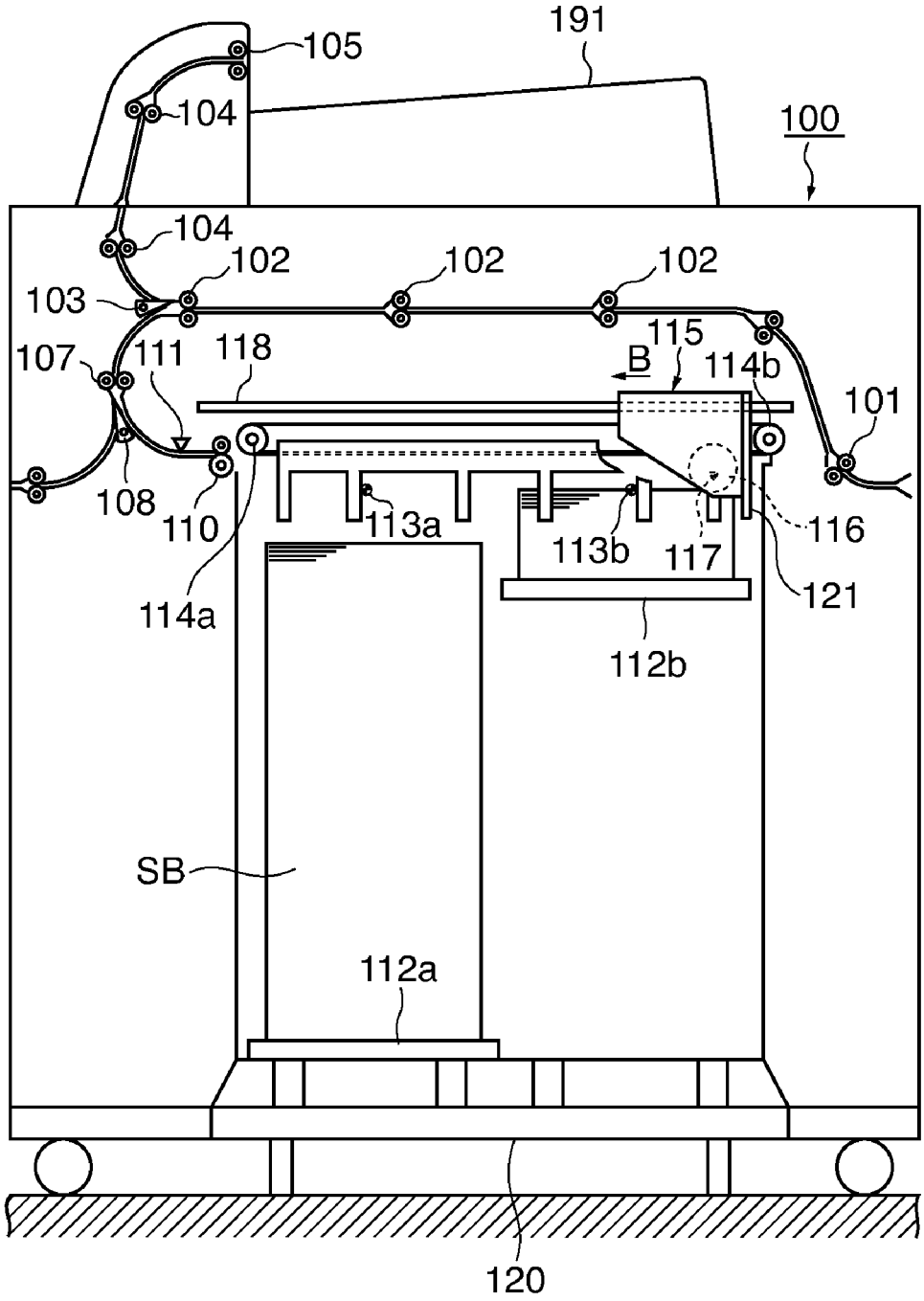
FIG. 13 is a cross-sectional view of essential parts of the stacker in a state where the sheet stacking process is being carried out using the other stacker tray.
Figure 14:
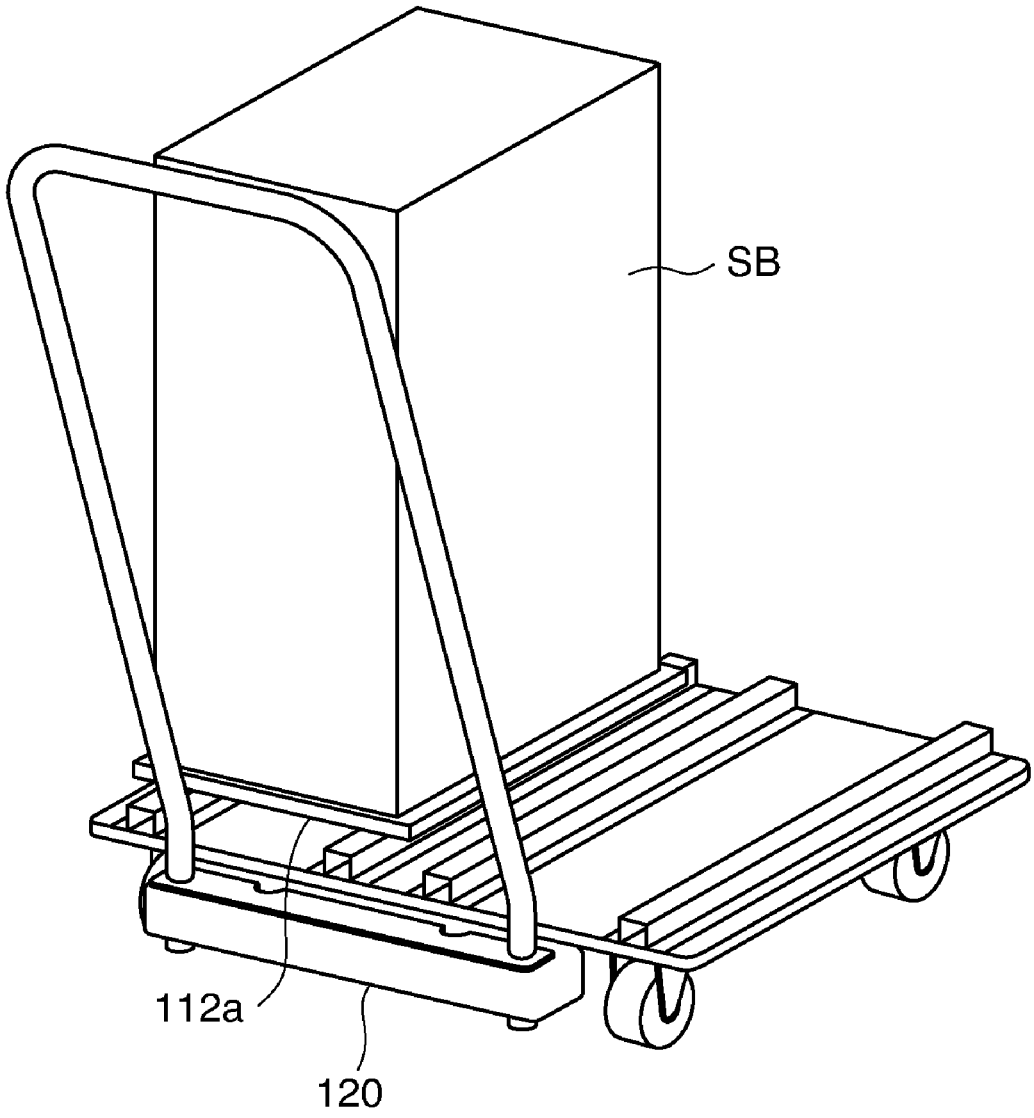
FIG. 14 is a perspective view of a small-size sheet bundle stacked on one stacker tray in a state where the sheet bundle is being conveyed from the stacker.

FIG. 13 shows the state of sheets S being stacked on the stacker tray 112*b* after the stacker tray 112*a* is fully stacked. At this time, the stacker tray 112*a* fully stacked with the sheet bundle SB is on the dolly 120. When the dolly 120 in this state is conveyed out of the stacker 100, the dolly 120 is placed in a state shown in FIG. 14. FIG. 14 is a perspective view of the small-size sheet bundle SB stacked on the stacker tray 112*a* in a state where the sheet bundle SB is being conveyed from the stacker 100.

As described above, it is possible to convey one of the stacker trays, fully stacked with the sheet bundle SB, out of the stacker 100 while stacking the sheets S on the other stacker tray. This enables the image forming apparatus 900 to continuously perform the image forming operation while conveying the sheet bundle SB out of the stacker 100. It should be noted that the fully stacked state of the sheets S stacked on the stacker tray 112*b* is detected similarly to the case of detection of the fully stacked state of the sheets S stacked on the stacker tray 112*a*.

Figure 15:
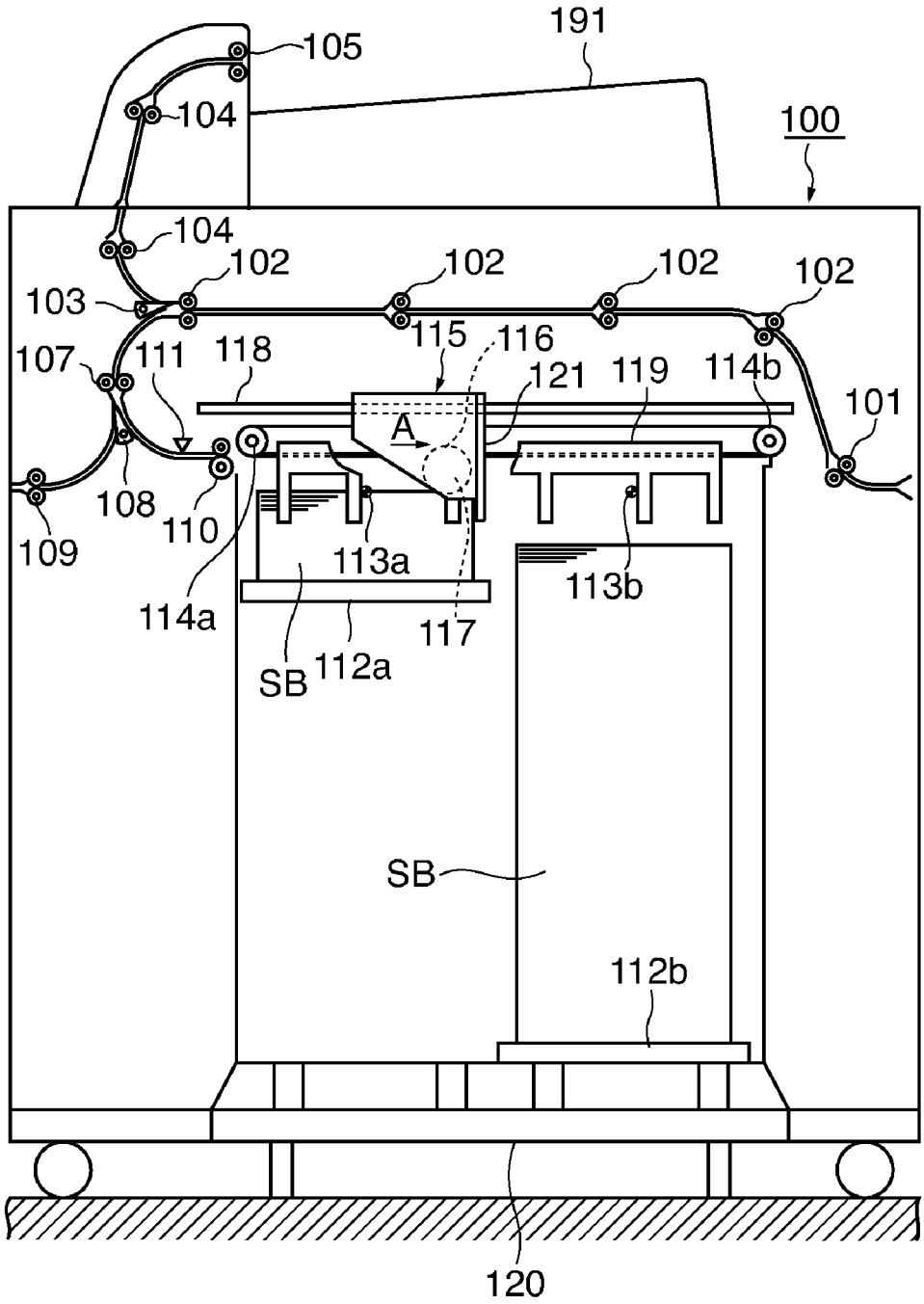
FIG. 15 is a cross-sectional view of the other stacker tray in a state fully stacked with the sheets.

After the stacker tray 112*a* is fully stacked with the sheet bundle SB, the user prepares for conveying the sheet bundle SB stacked on the stacker tray 112*a* out of the stacker 100 by the dolly 120, and stacking sheets S on the stacker tray 112*a* again. After that, when the sheets S are fully stacked on the stacker tray 112*b*, if the stacker 100 is ready for stacking sheets S on the stacker tray 112*a*, as shown in FIG. 15, the drawing unit 115 is moved to a position above the stacker tray 112*a*, for stacking the sheets S thereon. If a spare auxiliary stacker tray is provided, it is possible to use it as the stacker tray 112*a*.

When the sheets S are fully stacked on the stacker tray 112*b*, as shown in FIG. 15, the stacker tray 112*b* automatically lowers to be fixed on the dolly 120. FIG. 15 is a cross-sectional view of the stacker tray 112*b* in a state fully stacked with the sheets S.

Figure 16:
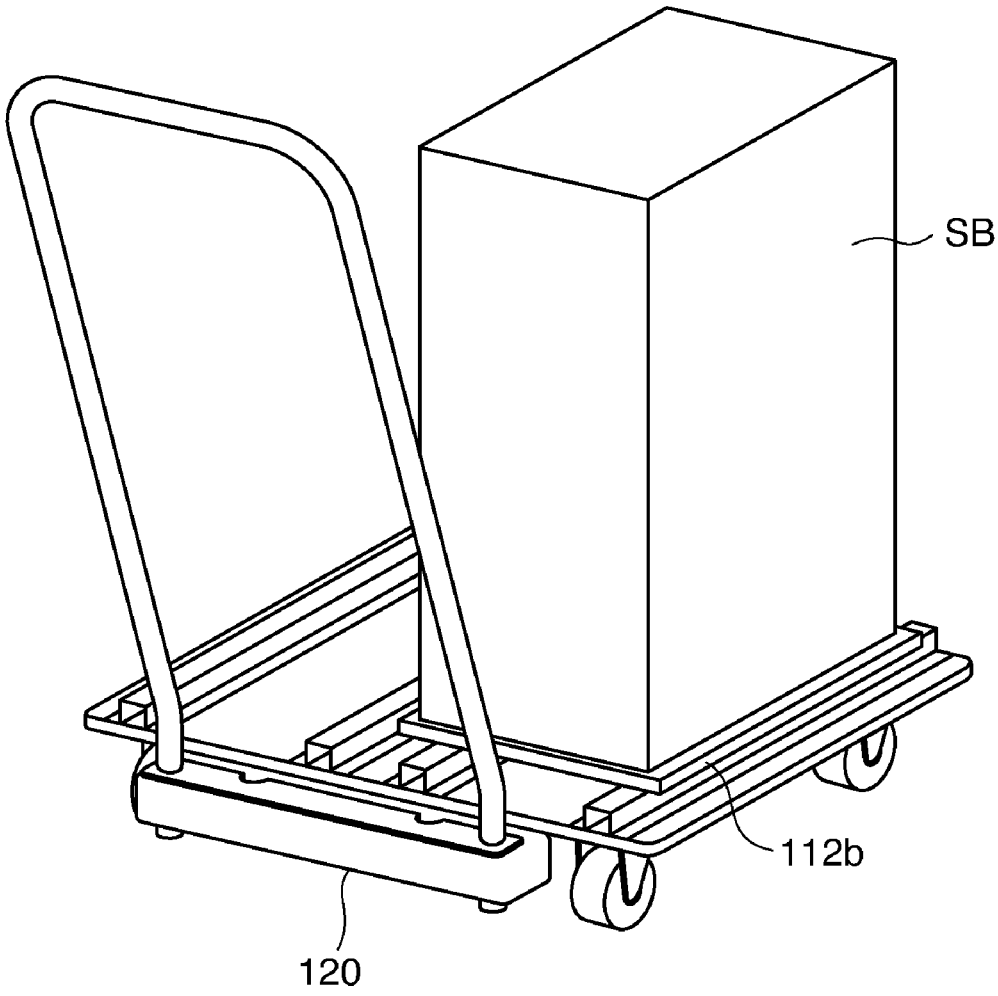
FIG. 16 is a perspective view of the small-size sheet bundle stacked on the other stacker tray in a state where the sheet bundle is being conveyed from the stacker.

As shown in FIG. 16, the sheet bundle SB stacked on the stacker tray 112*b* can be conveyed out of the stacker 100 similarly to the sheet bundle SB stacked on the stacker tray 112*a*. FIG. 16 is a perspective view of the small-size sheet bundle SB stacked on the stacker tray 112*b* in a state where the sheet bundle SB is being conveyed from the stacker 100.

As described hereinabove, sheet bundles SB fully stacked on the stacker trays 112*a* and 112*b* are sequentially conveyed out of the stacker 100, whereby it is possible to continuously produce bundles SB of sheets having images formed thereon, by one stacker 100, without stopping the operation of the image forming apparatus 900. In short, in stacking small-size sheets S, one of the stacker trays, which has already been fully stacked with a sheet bundle SB and for which the sheet stacking operation has been stopped, can be taken out, whereby it is possible to enhance the availability of the sheet stacking apparatus.

It should be noted that although in the above-described embodiment, the description has been given of the stacker provided with two stacker trays, this is not limitative, but even if the stacker is provided with three or more stacker trays, it is possible to obtain the same advantageous effects as provided by the stacker provided with two stacker trays.

Further, although in the above-described embodiment, the description has been given of a case where the gripper is used for conveying a sheet while holding the leading end thereof, by way of example, this is not limitative, but it is possible to obtain the same advantageous effects by any other configuration including a configuration of air suction and a configuration of electrostatic attraction, insofar as the configuration makes it possible to convey the sheet while holding the leading end thereof.

Figure 17:
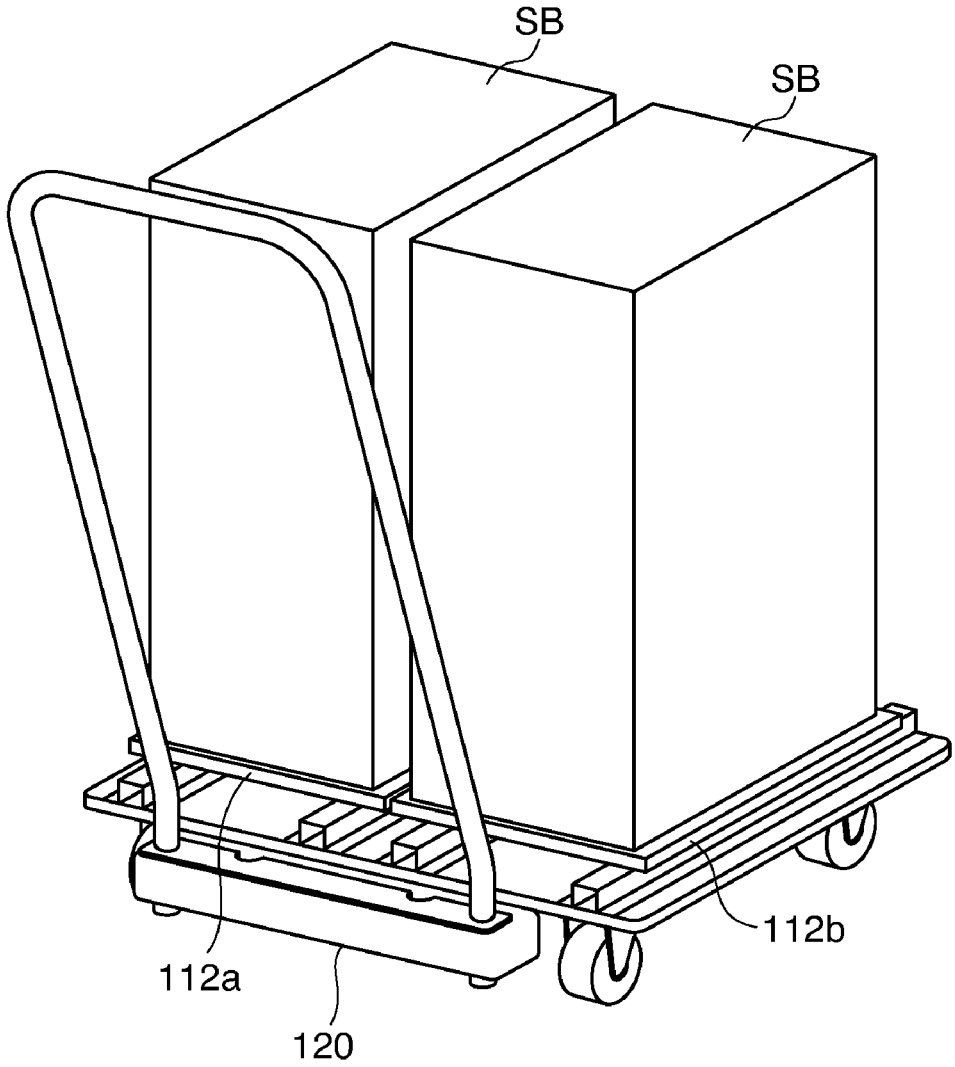
FIG. 17 is a perspective view of small-size sheet bundles stacked on respective two stacker trays in a state where the sheet bundles are being conveyed from the stacker.

Further, in the above-described embodiment, the stacker permits a sheet bundle SB which has already been stacked on one of the stacker trays 112*a* and 112*b* to be conveyed out, while permitting sheets S to be stacked on the other stacker tray, whereby it is possible to continuously load sheet bundles on the stacker trays. Such a mode of sheet stacking operation is a so-called "continuous run mode". However, even after one stacker tray is fully stacked, if sheets S continue to be stacked on the other stacker tray without conveying out the sheet bundle SB fully stacked on the one stacker tray, it is possible to use the stacker as one having a stacking capacity twice as large as that of the conventional stacker, as shown in FIG. 17.

Next, a sheet stacking process for stacking large-size sheets will be described with reference to FIGS. 18 to 21.

Figure 18:
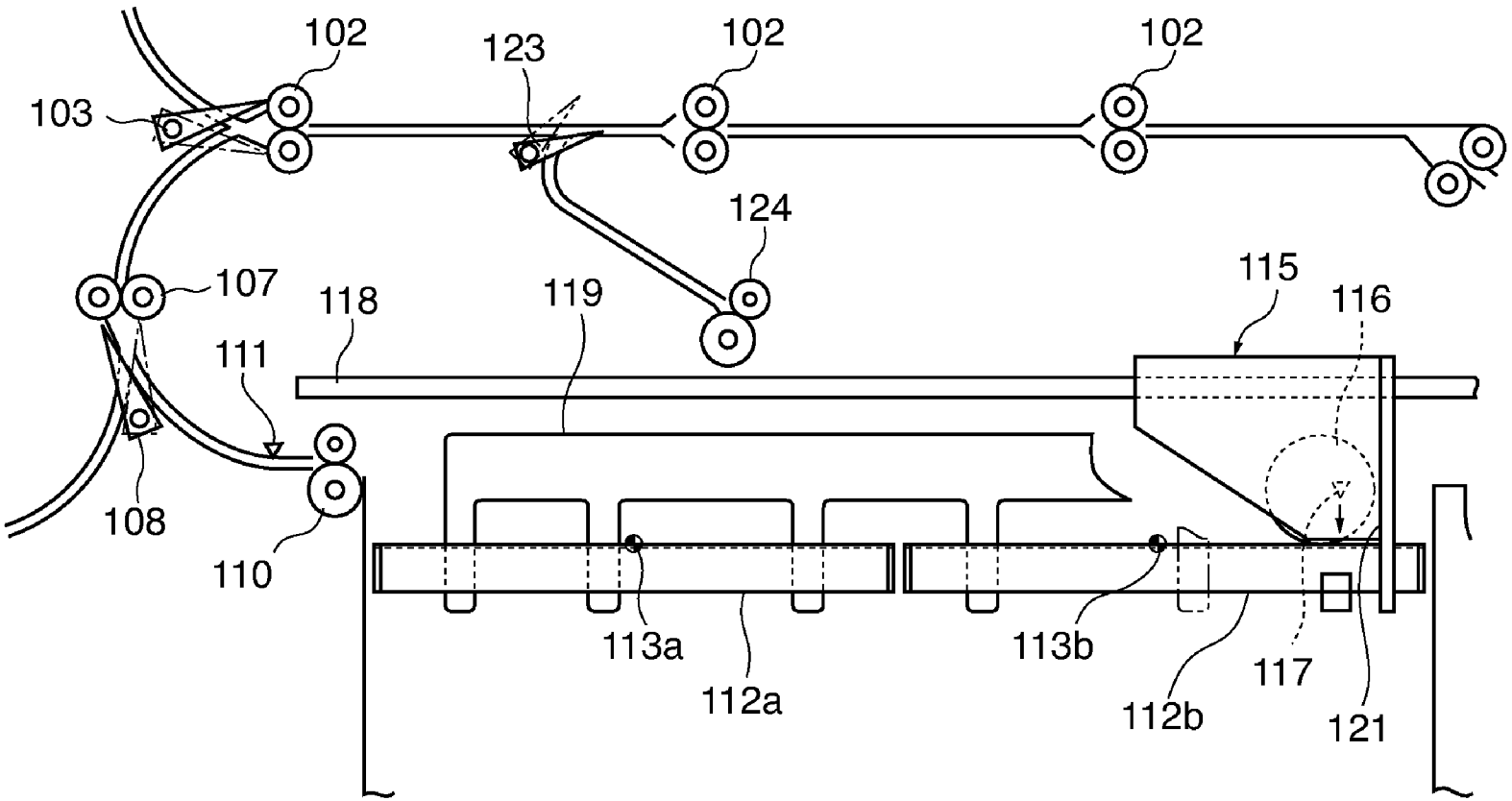
FIG. 18 is a cross-sectional view of essential parts of the stacker in a state where a sheet stacking process is being carried out for stacking large-size sheets.
Figure 19:
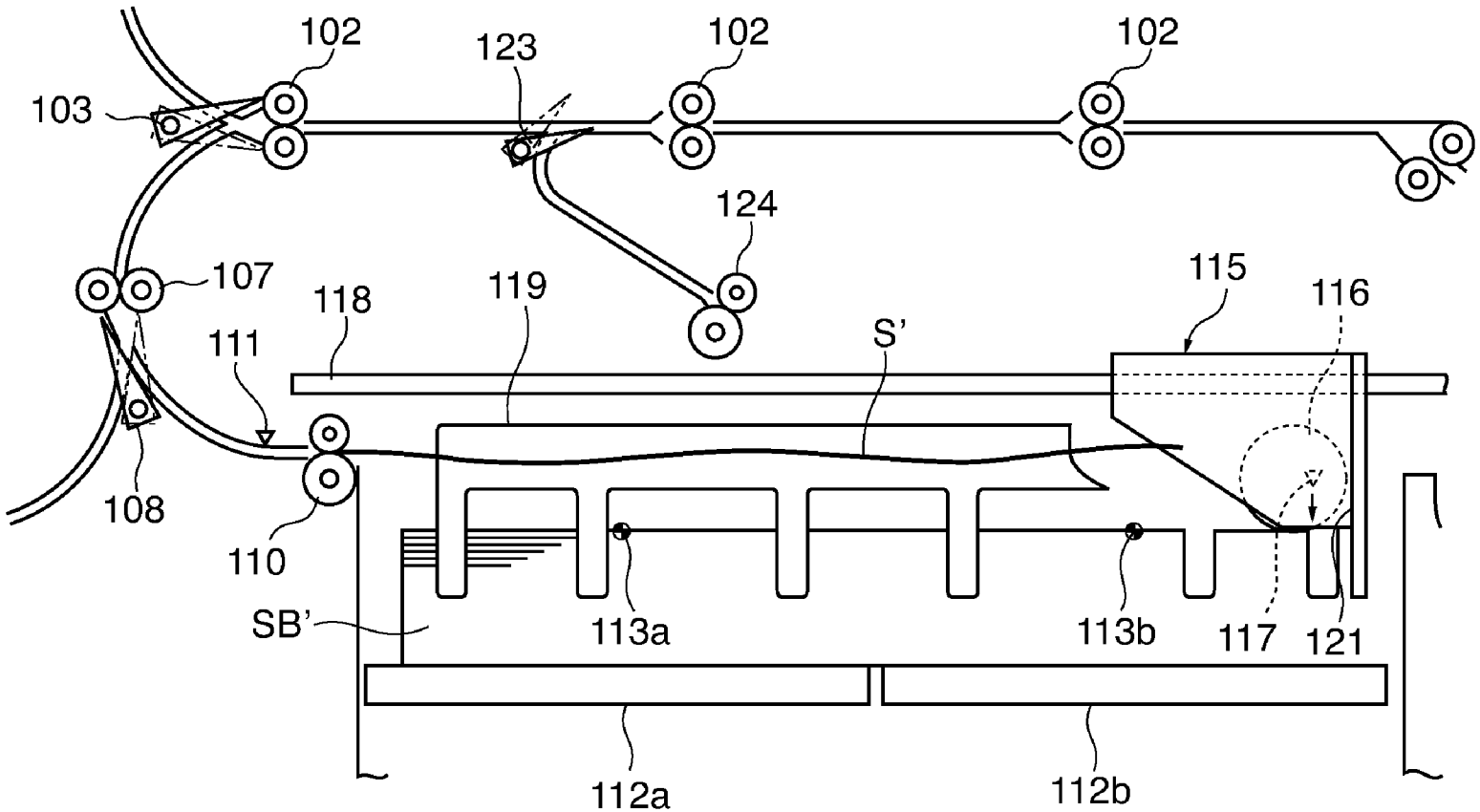
FIG. 19 is a cross-sectional view of essential parts of the stacker in a state where the sheet stacking process is being carried out for stacking large-size sheets.

FIGS. 18 and 19 are cross-sectional views of essential parts of the stacker in states during the sheet stacking process for stacking large-size sheets.

As described heretofore, before the sheets are conveyed to the stacker 100, information on the sheets S, such as information on the size and type of the sheets S, is notified to the stacker control section 210 by the CPU circuit section 211 of the image forming apparatus 900. The stacker control section 210 determines the number of stacker trays to be used in the sheet stacking process based on the notified information. In the present embodiment, in the case of stacking large-size sheets (larger than the A4 size), a plurality of stacker trays are used to cause the stacker trays to serve as one tray. More specifically, sheets are stacked in a state extending on the two stacker trays 112*a* and 112*b*. It should be noted that in this case, lifting operations of the respective stacker trays are controlled cooperatively with each other such that the two stacker trays 112*a* and 112*b* have the same height.

When large-size sheets S' are stacked, as shown in FIG. 18, first, the sheets S' are stacked in a state in which the drawing unit 115 is waiting above the stacker tray 112*b* on the downstream side of the plurality of stacker trays 112*a* and 112*b*. After the leading end of each sheet S' is detected by the timing sensor 111, the sheet S' is conveyed to the drawing unit 115 by the gripper 114*a*. The surface of each sheet S' stacked in a state extending on the stacker trays 112*a* and 112*b* is always monitored by a plurality of sensors, such as the sheet surface-detecting sensors 117, 113*a* and 113*b*.

In response to information on detections by these sensors, the stacker control section 210 controls the driving of the stacker tray lift motors 152*a* and 152*b* such that the sheet stacking surfaces of the stacker trays 112*a* and 112*b* are substantially level. As shown in FIG. 19, under the control of the stacker control section 210, while lowering the stacker trays 112*a* and 112*b*, the large-size sheets S' are stacked on the stacker trays 112*a* and 112*b*.

Figure 20:
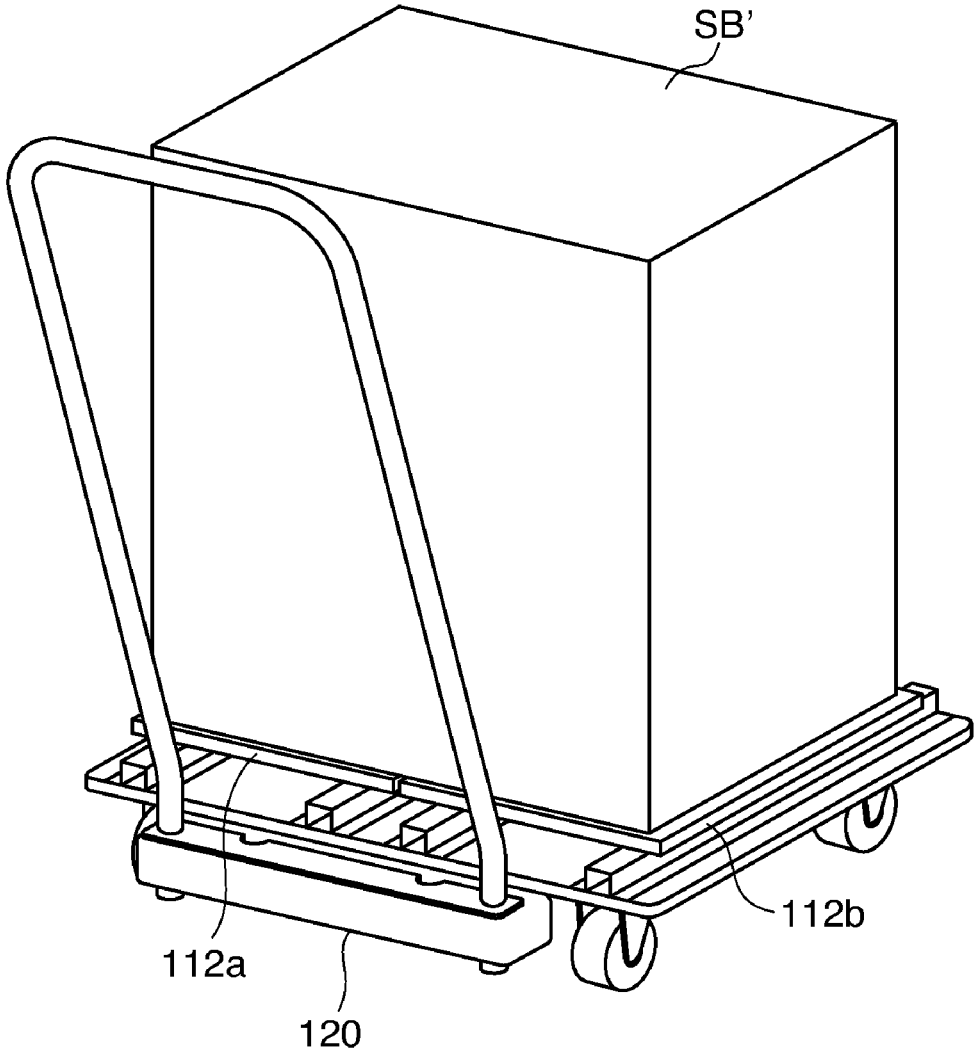
FIG. 20 is a perspective view of a large-size sheet bundle stacked on the two stacker trays in a state where the large-size sheet bundle is being conveyed from the stacker.

FIG. 20 is a perspective view of a large-size sheet bundle SB' stacked on the stacker trays 112*a* and 112*b* in a state where the large-size sheet bundle SB' is being conveyed from the stacker 100. That is, FIG. 20 shows the fully-stacked large-size sheet bundle SB' in a state conveyed out of the stacker 100 by the dolly 120. The large-size sheet bundle SB' is fixed on the dolly 120 in a state stacked on the plurality of stacker trays 112*a* and 112*b*.

As described above, in the stacker according to the present embodiment, large-size sheets are stacked using a plurality of stacker trays which are caused to operate as one tray so as to stack the sheets thereon such that they extend on the stacker trays, whereas when small-size sheets are stacked, they are stacked using one stacker tray. As a result, it is possible to make an efficient use of space within the stacker 100, and efficiently stack sheets of various sizes while realizing compactness of the stacker.

Figure 21:
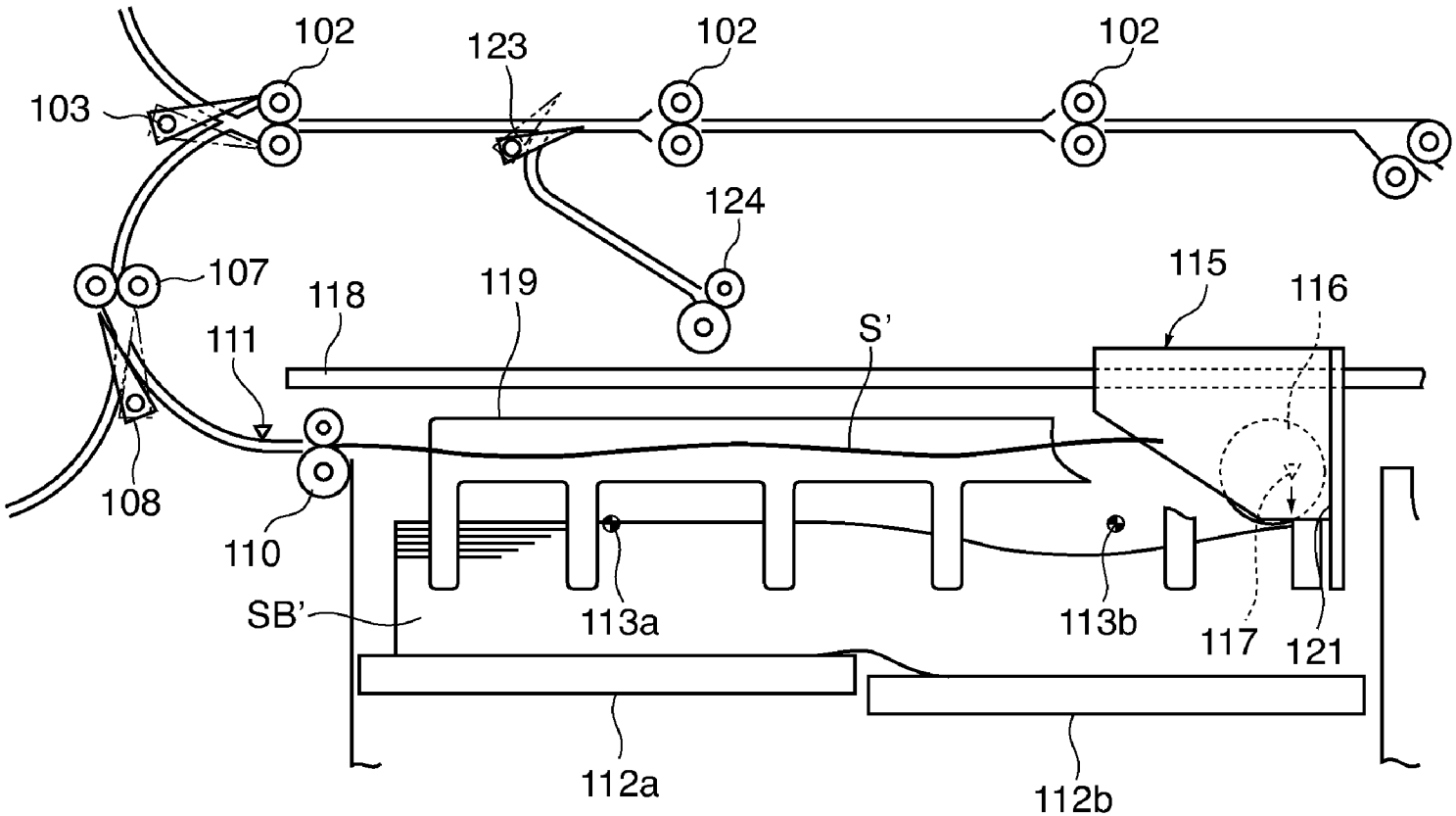
FIG. 21 is a cross-sectional view of essential parts of the stacker in a state where the sheet stacking process is being carried out for stacking large-size sheets.

Further, the above-described method of stacking sheets in a state extending on the plurality of stacker trays provides another advantageous effect. Normally, many sheets discharged from the image forming apparatus 900 have ends thereof curled, and curled positions of the sheets are different. FIG. 21 is a cross-sectional view of essential parts of the stacker in a state where the sheet stacking process is being carried out for stacking large-size sheets, which illustrates an example of stacking of sheets S' whose leading ends are curled upward.

If the ends of sheets are curled, in the stacker configured to stack sheets on one stacker tray as in the prior art, the ends of the sheets are lifted, which makes it difficult to maintain a substantially level top surface of the sheet bundle. In contrast, in the stacker configured to stack sheets in a state extending on a plurality of stacker trays as in the present embodiment, the positions of the upper surface of a sheet bundle on the respective stacker trays 112*a* and 112*b* are detected by the associated ones of the sheet surface-detecting sensors 117, 113*a* and 113*b*. This makes it possible to make the height of the top surface of the sheet bundle substantially constant along the sheet conveying direction, and thereby maintain a substantially level top surface of the sheet bundle SB. This makes it possible to smoothly stack sheets without causing sheet jamming even when the sheets discharged from the image forming apparatus 900 are curled.

In the example illustrated in FIG. 21, since the leading ends of the sheets S' are curled upward, the stacker tray 112*b* toward the leading ends of the sheets S' is lowered by a predetermined distance to thereby make substantially level the height of the sheet surface of the sheet bundle SB'. If the trailing ends of the sheets S' are curled upward, the stacker tray 112*a* is lowered by a predetermined distance, inversely to the above.

However, assuming that the level difference between the stacker trays 112*a* and 112*b* becomes too large, even if sheets can be stacked, when the sheet bundle SB' is conveyed by the dolly 120 after stacking of the sheets, the level difference is eliminated, i.e. the heights of the stacker trays 112*a* and 112*b* are made equal to each other. As a consequence, the sheets stacked on the stacker trays 112*a* and 112*b* are largely curled, which results in the markedly degraded quality of the sheet bundle.

To solve this problem, when a level difference larger than a predetermined amount is produced between the stacker trays 112*a* and 112*b*, the operation for stacking sheets S' is stopped, for example. Alternatively, there may be taken a countermeasure e.g. by displaying a message saying that sheets being stacked are largely curled, on the operating section 209, to notify the user of the level difference in advance during the sheet stacking operation.

Although in the present embodiment, the description has been given of the stacker configured such that the drawing unit is disposed above the stacker trays, by way of example, the present invention is by no means limited to this configuration. The stacker may be configured such that sheets can be selectively stacked on a plurality of stacker trays or sheets can be stacked in a state extending on a plurality of movable stacker trays.

Next, a case where one of a plurality of stacker trays of the sheet stacking apparatus according to the present embodiment becomes faulty will be described with reference to FIGS. 22 to 26.

Figure 22:
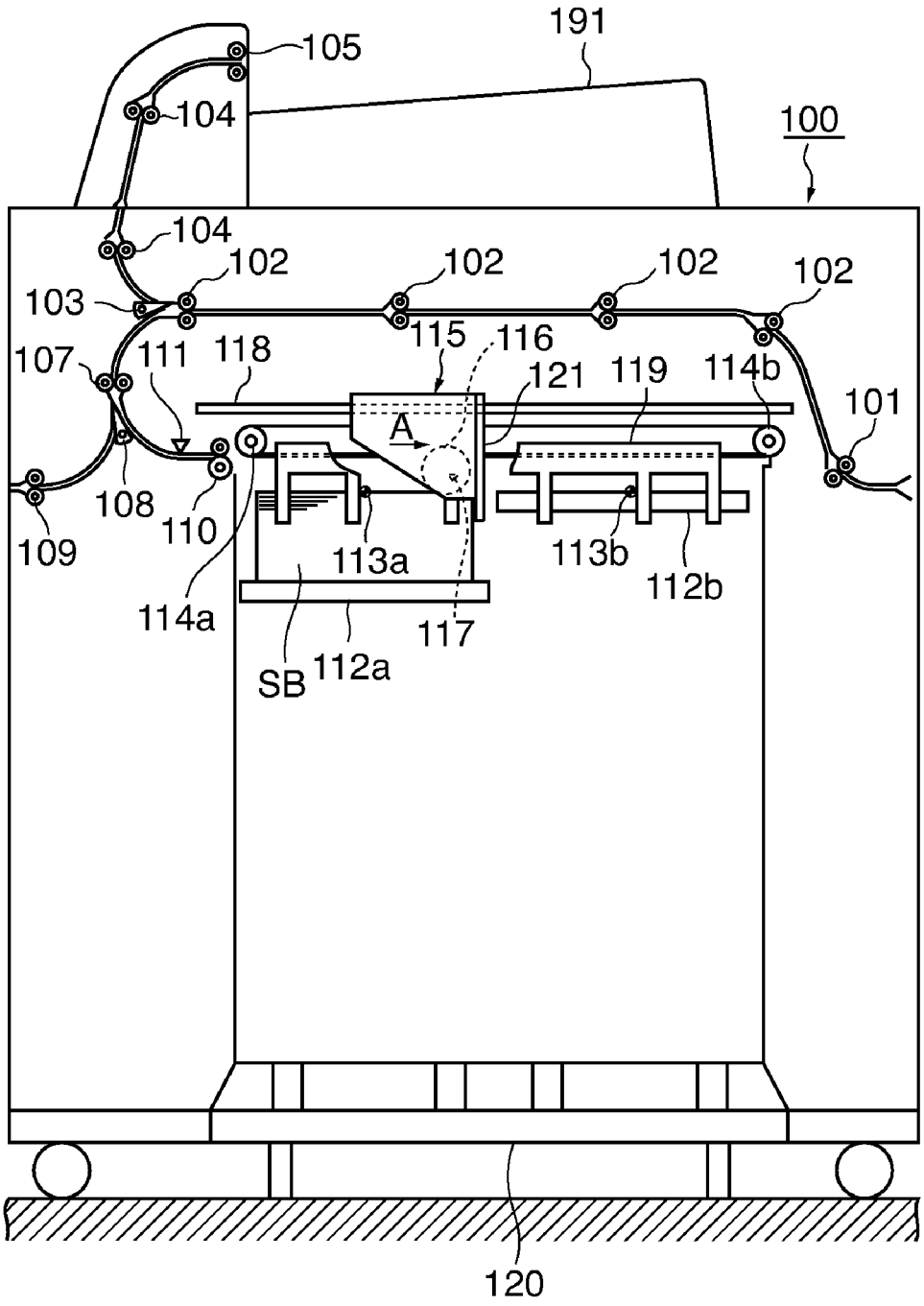
FIG. 22 is a cross-sectional view of essential parts of the stacker, which is useful in explaining a state where the stacker has a faulty stacker tray.
Figure 23:
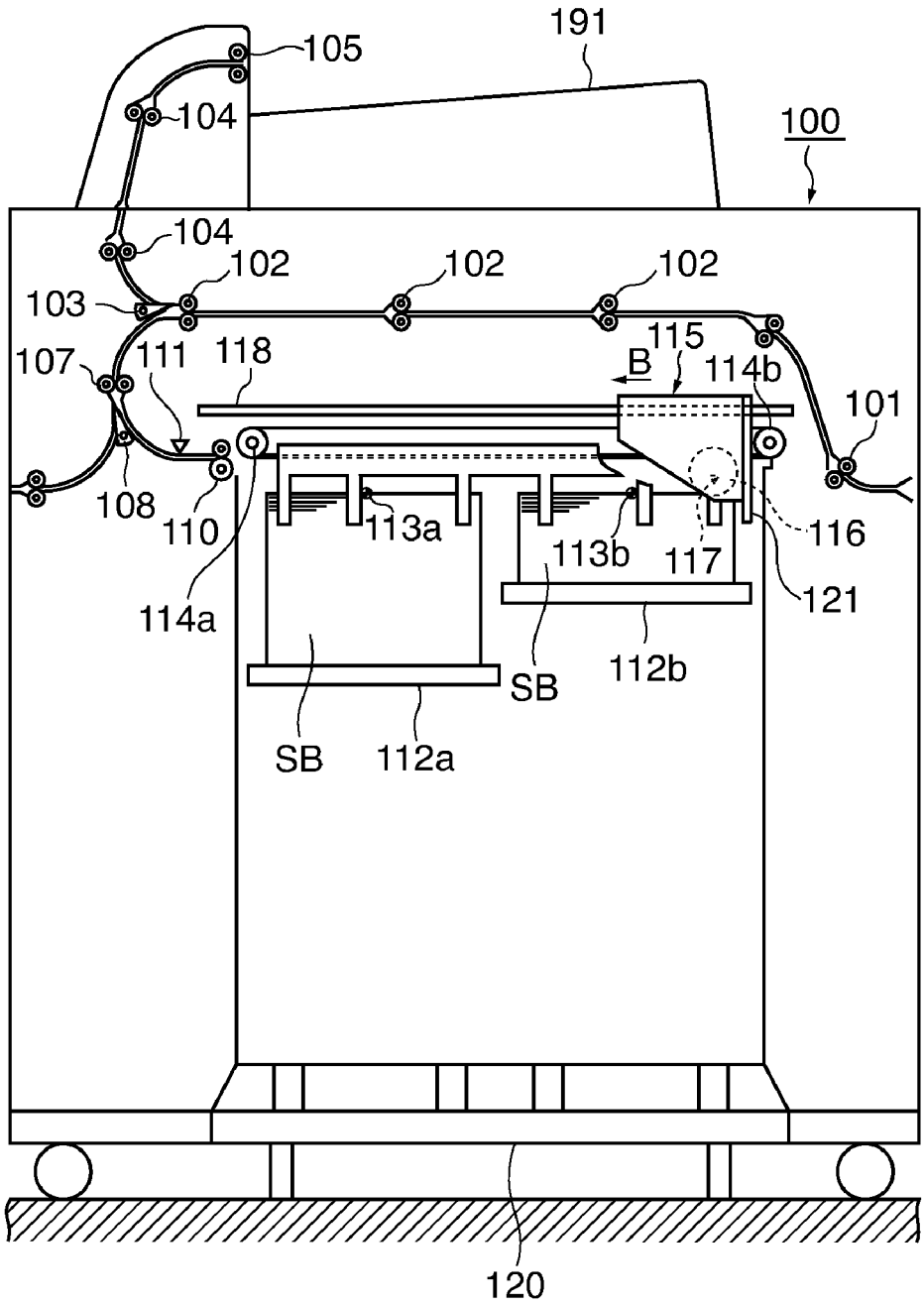
FIG. 23 is a cross-sectional view of essential parts of the stacker, which is useful in explaining the state where the stacker has a faulty stacker tray.

FIGS. 22 and 23 are cross-sectional views of essential parts of the stacker according to the present embodiment, which is useful in explaining a state where the sheet stacking process has a faulty stacker tray.

FIG. 22 illustrates a state of the stacker 100 in which small-size sheets S are stacked on the stacker tray 112*a*. The sheets S are each conveyed to the drawing unit 115 on standby above the upstream stacker 112*a* by the gripper 114*a*, and are sequentially stacked on the stacker tray 112*a*. Now, let it be assumed that the stacker tray 112*a* become faulty during the operation of stacking sheets S on the stacker tray 112*a*. The fault of the stacker tray 112*a* is assumed here to be an incapability of the lifting/lowering operation of the tray lift motor 152*a* due to some cause.

The fault of the stacker tray 112*a* is determined based on a result of detection by the lift motor encoder 132*a*. When the predetermined amount of operation instructed to the tray lift motor 152*a* by the CPU 170 of the stacker control section 210 and the result of detection by the encoder 132*a* are different from each other, it is determined that the stacker tray 112*a* is faulty.

During stacking of sheets, the position of the top surface of the sheet bundle SB stacked on the stacker tray 112*a* (in the lifting/lowering direction) is detected by the sheet surface-detecting sensor 113*a*, and the stacker tray 112*a* is operated such that the distance between the top surface of the sheet bundle SB and the drawing unit 115 is held constant. Therefore, if the lifting/lowering operation of the stacker tray 112*a* become impossible, it is impossible to carry out the mounting of sheets on the stacker tray 112*a*.

Upon detection of the fault, the operation of stacking sheets on the stacker tray 112*a* is stopped, and as shown in FIG. 23, the drawing unit 115 is moved to a position over the stacker tray 112*b*, and the stacker tray on which sheets are to be stacked is switched to the stacker tray 112*b* to start stacking of sheets thereon. When the stacking of sheets on the stacker tray 112*b* is started, normally, sheets S are each conveyed to the drawing unit 115 on standby above the stacker tray 112*b* by the gripper 114*a*, and are sequentially stacked on the stacker tray 112*b*. In this case, since only the stacker tray 112*b* of the plurality of stackers is available, the size of sheets which can be stacked is a small size.

After the stacking of sheets on the stacker tray 112*b* is started, when the stacker 112*b* is fully stacked with sheets S, the stacker tray 112*b* is lowered and fixed on the dolly 120. After the stacker tray 112*b* is taken out by the dolly 120, when the stacker tray 112*b* is set in the stacker 100 again, the stacker tray 112*b* is lifted up to a position where the stacking of sheets is possible. When the stacking of sheets on the stacker tray 112*b* becomes possible, the stacking of sheets on the stacker tray 112*b* is started again.

Thus, even when one of the stacker trays becomes faulty, by changing the stacker tray to the other on which sheets can be stacked, the stacker 100 can be continuously operated without being stopped.

Next, a description will be given of a job configuration performed when the stacker tray 112*a* becomes faulty as described above.

FIGS. 24A, 24B, 25A and 25B are views of an operating screen useful in explaining the job configuration performed when the stacker according to the present embodiment has a faulty stacker tray.

Figure 24A:
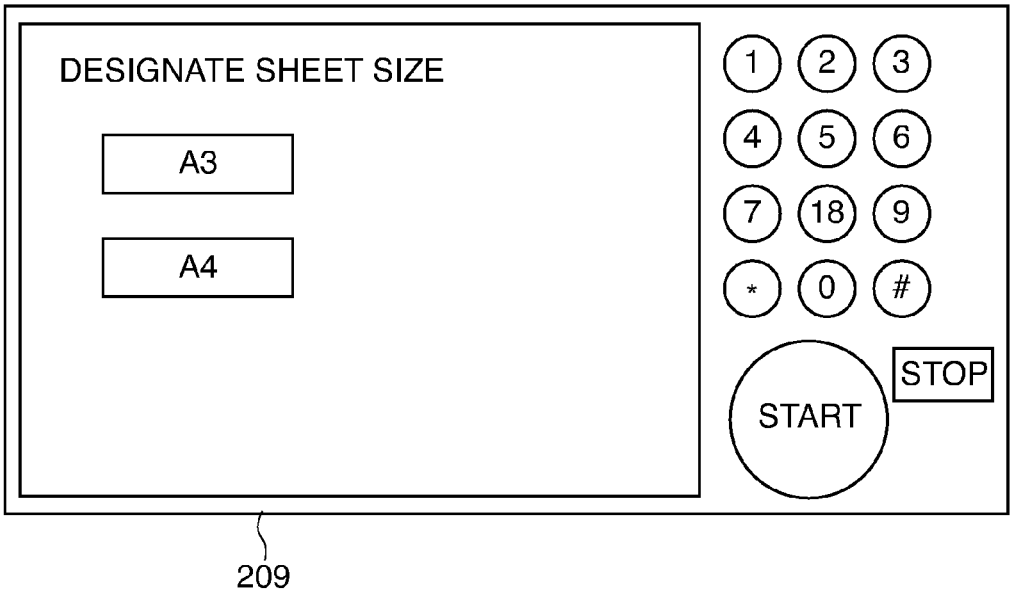
FIGS. 24A and 24B are views of an operating screen which is useful in explaining a job configuration performed when the stacker has a faulty stacker tray.
Figure 24B:
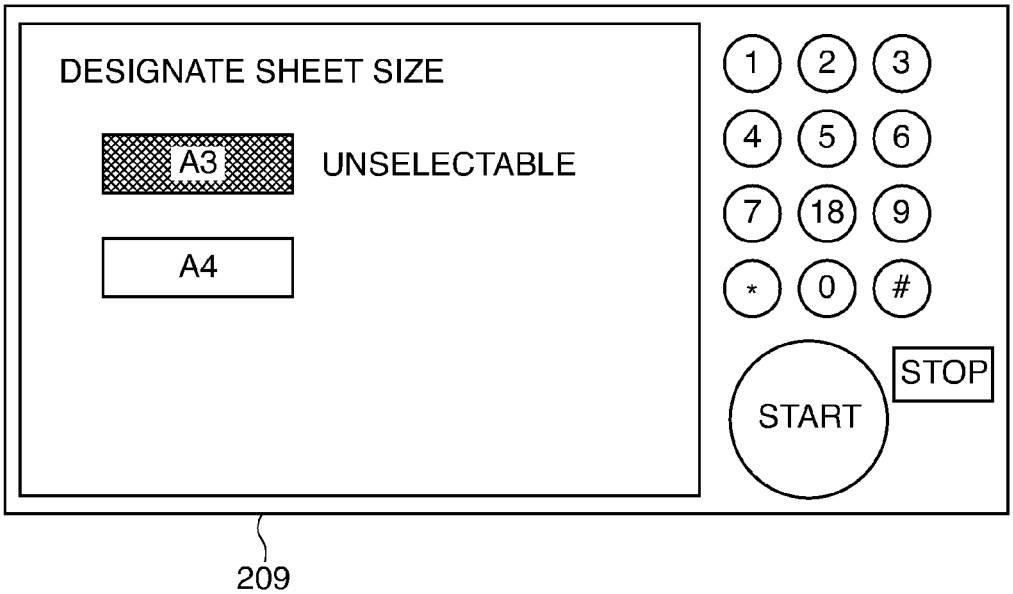

Let it be assumed that the image forming apparatus 900 has A4-size sheets set in the cassettes 902*a* and 902*b*, and A3-size sheets set in the cassettes 902*c* and 902*d*. In performing the job configuration from the operating screen of the operating section 209, normally, as shown in FIG. 24A, A3 size and A4 size are displayed as selectable as the size of sheets. If the stacker tray 112*a* becomes faulty, making only the stacker tray 112*b* available, and if the stacker 100 is selected as a destination of discharge of sheets, A3 size is made unselectable by graying out the display thereof, and only A4 size is made selectable, as shown is FIG. 24B.

This is because as described hereinabove, in the case of the A3 size, which is a large size, sheets having this size are required to be stacked in a state extending on the stacker trays 112*a* and 112*b*, and hence if the only the stacker tray 112*b* is available due to a fault of the stacker tray 112*a*, the stacking of A3-size sheets becomes impossible.

Figure 25A:
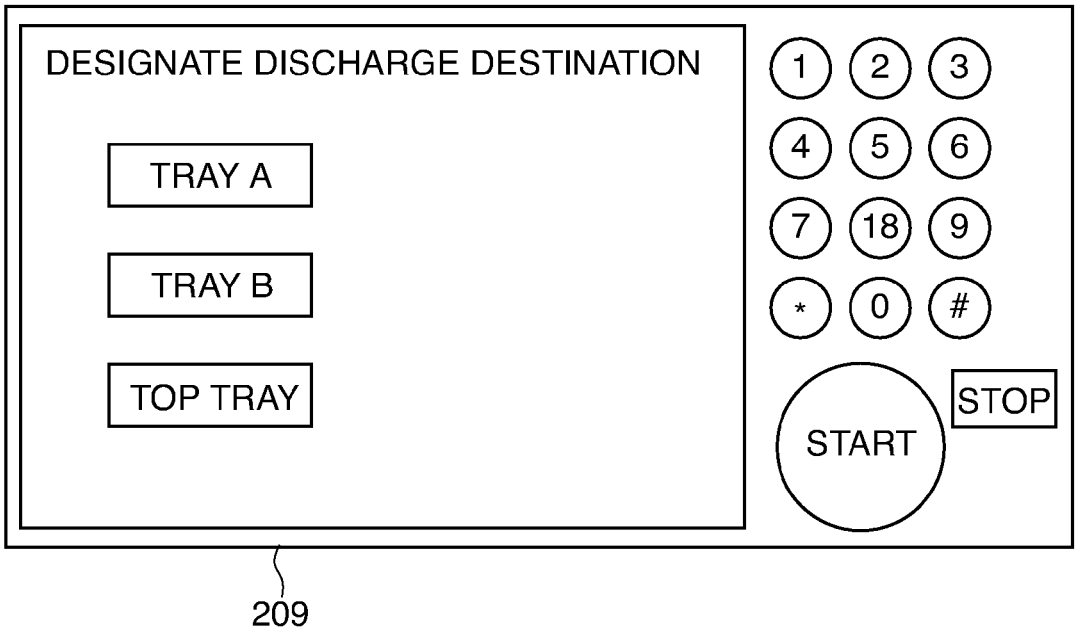
FIGS. 25A and 25B are views of an operating screen which is useful in explaining the job configuration performed when the stacker has a faulty stacker tray.
Figure 25B:
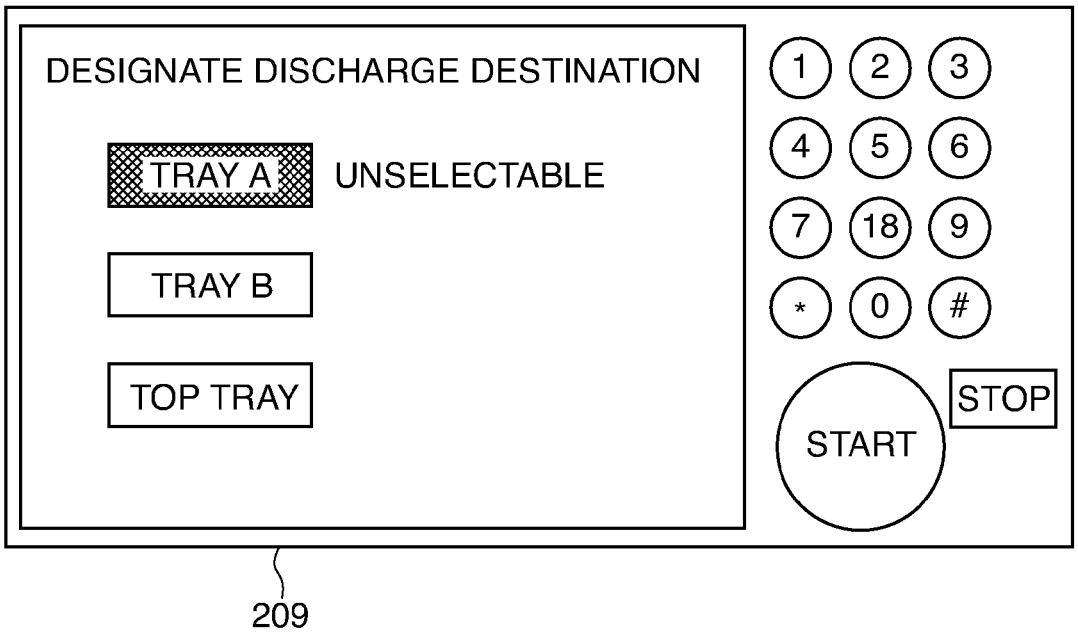

Further, when a sheet discharge destination to which sheets having images formed thereon are to be discharged is selected from the operating section 209, as shown in FIG. 25A, normally, the stacker trays 112*a* and 112*b* and the top tray 106 are selectable. If the stacker tray 112*a* becomes faulty, and only the stacker tray 112*b* is available, as shown in FIG. 25B, it is made impossible to select the stacker tray 112*a* as a sheet discharge destination on the operating section 209. The stacker tray 112*b* and the top tray 106 remain selectable as a sheet discharge destination. It should be noted that if the use of A3-size sheets has already been selected, both the stacker trays 112*a* and 112*b* are made unelectable.

Next, a description will be given of a control process performed in the case where there is a faulty stacker tray with reference to FIG. 26.

Figure 26:
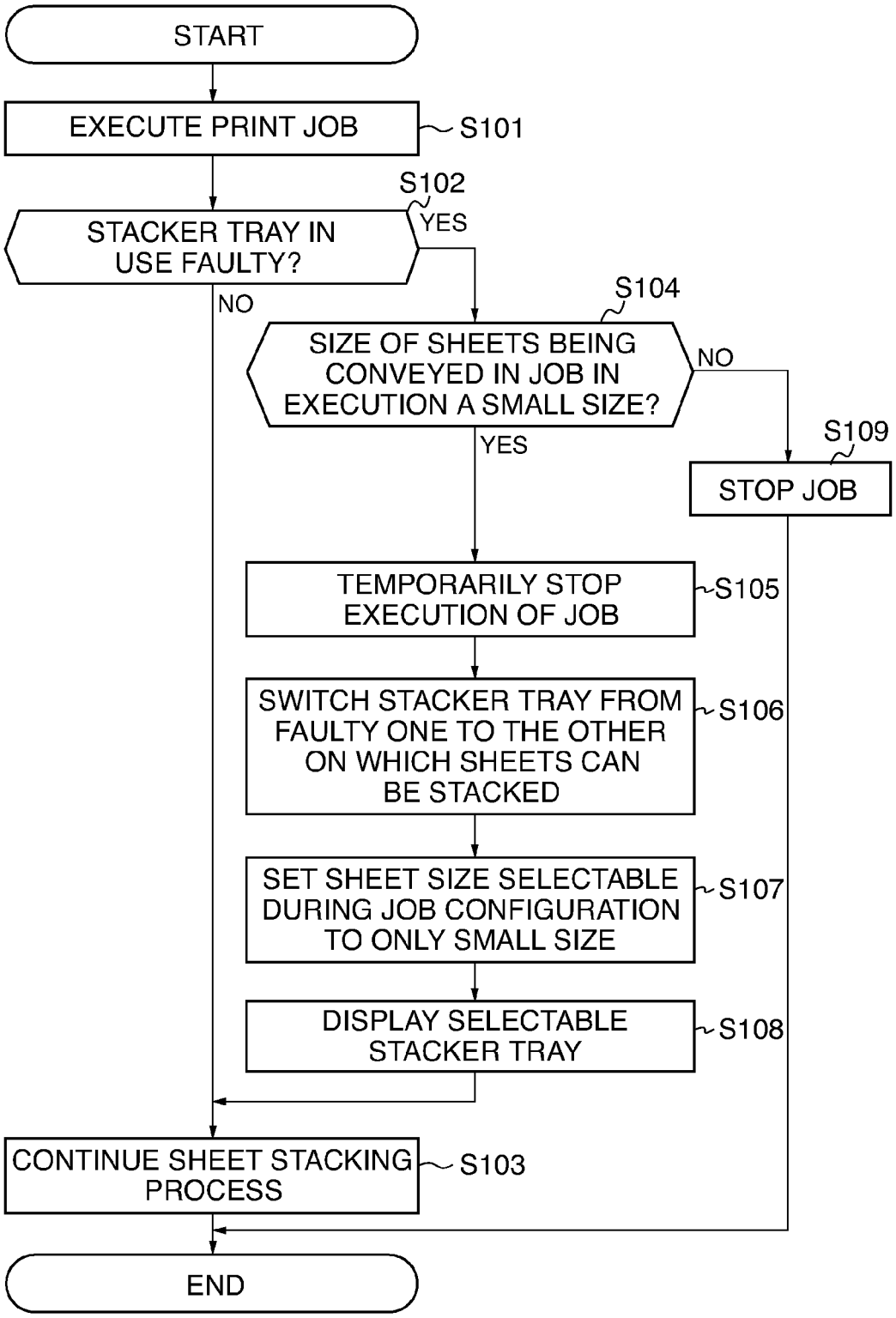
FIG. 26 is a flowchart of a control process executed when the stacker has a faulty stacker tray.
Figure 27:
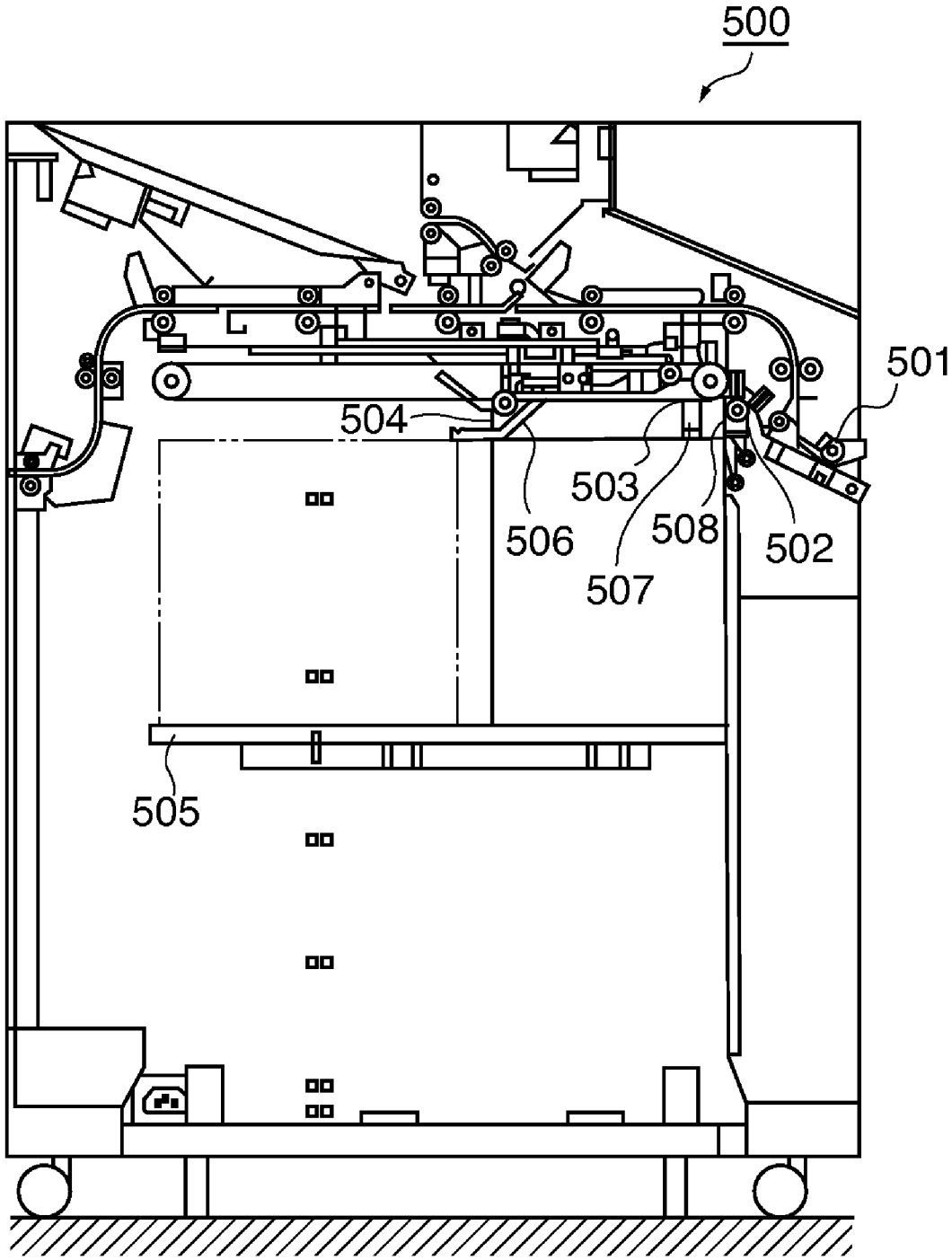
FIG. 27 is a schematic cross-sectional view of a conventional sheet stacking apparatus.

FIG. 26 is a flowchart of a control process executed when the stacker according to the present embodiment has a faulty stacker tray. It should be noted that this process can be realized by the CPU 206 executing a program code stored in the ROM 207 on the image forming apparatus 900 side and the CPU 170 executing a program code stored in the ROM 172 on the stacker 100 side.

First, the CPU 206 executes a print job involving the stacking of sheets on a stacker (S101). The CPU 170 starts the aforementioned sheet stacking process according to an instruction from the CPU 206. The CPU 170 constantly detects whether or not there is any faulty stacker tray, and if a faulty stacker tray is detected, the CPU 170 notifies the faulty stacker to the CPU 206. The CPU 170 stops the operation of stacking sheets on the faulty stacker tray. Through communication with the CPU 170, the CPU 206 determines whether or not the stacker tray in use of the stacker 100 is faulty (S102). Unless it is determined in the step S102 that the stacker tray in use is faulty, the process proceeds to a step S103, wherein the CPU 170 is permitted to continue the sheet stacking process.

If it is determined in the step S102 that the stacker tray in use is faulty, the CPU 206 determines whether or not the size of sheets being conveyed by the job in execution is a small size (S104). If it is determined in the step S104 that the sheet size is a small size, the CPU 206 temporarily stops the execution of the job (S105). The CPU 206 instructs the CPU 170 to switch the faulty stacker tray to the other stacker tray on which sheets can be stacked (S106). Then, the CPU 206 sets the sheet size selectable during job configuration to only the small size (S107), and inhibits the selection of the faulty stacker tray while causing the selectable stacker tray to be displayed on the operating section 209 (S108).

Thereafter, the CPU 206 resumes the temporarily stopped job whereby the sheet stacking process continues to be executed. The CPU 170 carries out the aforementioned switching of the stacker tray, and resumes the sheet stacking process temporarily stopped. If it is determined in the step S104 that the size of sheets used in the job in execution is not a small size, the CPU 206 stops the job (S109).

As described above, when one of the plurality of stacker trays is faulty, the stacking of large-size sheets cannot be executed. However, since the other stacker tray which is not faulty is available, it is possible to stack small-size sheets by using the other stacker tray. If the other stacker tray which is not faulty and hence is capable of operating is also stopped, the availability of the stacker 100 is markedly lowered. In view of this, according to the present embodiment, when one of the stacker trays becomes faulty, the other stacker tray capable of operating is put into use for the sheet stacking process, whereby the operation of the stacker can be continued without stopping the same. Thus, it is possible to stack small-size sheets even when one of the stacker trays becomes faulty. The amount of small-size sheets which the stacker 100 stacks can be made equal to the sheet-stacking amount of the conventional stacker using only one stacker tray.

Although in the present embodiment, the job configuration is executed from the image forming apparatus 900, this is not limitative, but it may be executed from a computer connected thereto over the network.

It is to be understood that the present invention may also be accomplished by supplying a system or an apparatus with a storage medium in which a program code of software, which realizes the functions of the above-described embodiment, is stored, and causing a computer (or CPU or MPU) of the system or apparatus to read out and execute the program code stored in the storage medium.

In this case, the program code itself read from the storage medium realizes the functions of the above-described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above-described embodiment may be accomplished not only by executing the program code read out by a computer, but also by causing an OS (operating system) or the like which operates on the computer to perform a part or all of the actual operations based on instructions of the program code.

Further, it is to be understood that the functions of the above-described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-170997 filed Jun. 28, 2007, which is hereby incorporated by reference herein in its entirety.

What is claimed is:

1. A sheet stacking apparatus comprising:

first and second sheet-stacking units configured to stack sheets discharged from an image forming apparatus thereon;

lifting driving units configured to cause lifting and lowering operations of said first and second sheet-stacking units;

a control unit configured to cause selective execution of one of a first stacking mode in which sheets are caused to be stacked on one of said first and second sheet-stacking units, and a second stacking mode in which sheets are caused to be stacked in a state extending on said first sheet-stacking unit and said second sheet-stacking unit; and an abnormality determination unit configured to determine whether or not any of said first and second sheet-stacking units is abnormal in a lifting/lowering operation by said lifting driving units, wherein when said abnormality determination unit determines that one of said first and second sheet-stacking units is abnormal in the lifting/lowering operation, said control unit inhibits execution of the second stacking mode, and permits execution of the first stacking mode using the other of said first and second sheet-stacking units.

2. A sheet stacking apparatus as claimed in claim 1, comprising a configuration unit configured to configure a job concerning an image forming operation, wherein when said abnormality determination unit determines that any of said first and second sheet-stacking units is abnormal in the lifting/lowering operation, said control unit controls said configuration unit such that setting of a job using sheets having a size larger than a predetermined size is inhibited.

3. A sheet stacking apparatus as claimed in claim 2, wherein when said abnormality determination unit determines that any of said first and second sheet-stacking units is abnormal in the lifting/lowering operation, said control unit causes information on a sheet-stacking unit which cannot be used to be displayed on said configuration unit.

4. A sheet stacking apparatus as claimed in claim 1, wherein in the first stacking mode, sheets having a size not larger than a predetermined size are stacked, and in the second stacking mode, sheets having a size larger than the predetermined size are stacked.

5. A method of controlling a sheet stacking apparatus including first and second sheet-stacking units configured to stack sheets discharged from an image forming apparatus thereon, and lifting driving units configured to cause lifting and lowering operations of said first and second sheet-stacking units, the method comprising:

a stacking mode-selecting step of selecting one of a first stacking mode in which sheets are caused to be stacked on one of said first and second sheet-stacking units, and a second stacking mode in which sheets are caused to be stacked in a state extending on said first sheet-stacking unit and said second sheet-stacking unit;

an abnormality determination step of determining whether or not any of said first and second sheet-stacking units is abnormal in a lifting/lowering operation; and a control step of, when said abnormality determination unit determines that one of said first and second sheet-stacking units is abnormal in the lifting/lowering operation, inhibiting execution of the second stacking mode, and permitting execution of the first stacking mode using the other of said first and second sheet-stacking units.

* * * * *